US011119526B2

(12) United States Patent
Horii

(10) Patent No.: US 11,119,526 B2
(45) Date of Patent: Sep. 14, 2021

(54) OPERATION DEVICE AND WORKING MACHINE

(71) Applicant: KUBOTA CORPORATION, Osaka (JP)

(72) Inventor: Hiroshi Horii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 340 days.

(21) Appl. No.: 16/227,825

(22) Filed: Dec. 20, 2018

(65) Prior Publication Data

US 2019/0121386 A1 Apr. 25, 2019

Related U.S. Application Data

(63) Continuation of application No. PCT/JP2017/045781, filed on Dec. 20, 2017.

(30) Foreign Application Priority Data

Dec. 22, 2016 (JP) ..... JP2016-250140
Dec. 22, 2016 (JP) ..... JP2016-250141

(51) Int. Cl.
*E02F 9/20* (2006.01)
*G05G 9/047* (2006.01)
(Continued)

(52) U.S. Cl.
CPC ..... *G05G 9/047* (2013.01); *E02F 9/20* (2013.01); *E02F 9/2004* (2013.01); *G05G 1/06* (2013.01);
(Continued)

(58) Field of Classification Search
CPC ..... E02F 9/20; E02F 9/2004; G05G 9/047; G05G 2009/04718; G05G 2009/04714;
(Continued)

(56) References Cited

U.S. PATENT DOCUMENTS 3,771,037 A * 11/1973 Bailey, Jr. ..... B64C 13/0421 318/580
4,555,960 A * 12/1985 King ..... G05G 9/047 200/6 A
(Continued)

FOREIGN PATENT DOCUMENTS

CN 1179218 A 4/1998
CN 1652273 A 8/2005
(Continued)

OTHER PUBLICATIONS

Author Unknown, "Chapter 4 Control and Operation Excavator", Date Unknown, pp. 84-86 (with English translation, 10 pages total.

*Primary Examiner* — Richard W Ridley
*Assistant Examiner* — Brian J McGovern
(74) *Attorney, Agent, or Firm* — Birch, Stewart, Kolasch & Birch, LLP

(57) ABSTRACT

An operation device includes a grip to be grasped by an operator, and a supporting portion supporting the grip and allowing the grip to be turned in an arbitrary turning direction. A rotation fulcrum of the grip is positioned inside the grip. In this manner, the present invention requires less hand operation and is configured to be stably operated even when a machine body is shaken.

20 Claims, 21 Drawing Sheets

(51) Int. Cl.
*G05G 1/06* (2006.01)
*G05G 5/05* (2006.01)
*G05G 25/04* (2006.01)

(52) U.S. Cl.
CPC ..... *G05G 5/05* (2013.01); *G05G 25/04* (2013.01); *G05G 2009/04718* (2013.01); *G05G 2505/00* (2013.01)

(58) Field of Classification Search
CPC ..... G05G 2009/04703; G05G 2009/04748; G05G 1/04; G05G 1/06; G05G 5/05; G05G 25/04
See application file for complete search history.

(56) References Cited

U.S. PATENT DOCUMENTS 5,142,931 A * 9/1992 Menahem ..... G05G 9/047 244/234
5,224,589 A 7/1993 Karakama et al.
5,251,534 A * 10/1993 Yonekubo ..... E02F 9/2004 137/636.2
5,576,704 A * 11/1996 Baker ..... G05G 9/047 200/6 A
5,598,090 A * 1/1997 Baker ..... G05G 9/047 273/148 B
6,328,127 B1 * 12/2001 Hori ..... B62D 11/183 180/333
6,435,289 B1 * 8/2002 Hori ..... B62D 11/183 180/315
8,262,479 B2 * 9/2012 Bandera ..... B64C 13/0421 463/37
9,045,219 B2 * 6/2015 Bandera ..... G05G 9/047
2005/0034915 A1 * 2/2005 Kumazawa ..... G05G 1/08 180/331
2005/0097787 A1 * 5/2005 Meyeres ..... E02F 9/2004 37/348
2011/0284785 A1 * 11/2011 Yoshimoto ..... F16J 15/52 251/229
2012/0152719 A1 * 6/2012 Schulein ..... G05G 9/047 200/6 R
2015/0345991 A1 * 12/2015 Kageyama ..... F15B 13/0424 324/207.13
2015/0354175 A1 * 12/2015 Jung ..... F16K 15/04 137/312

FOREIGN PATENT DOCUMENTS

CN 101145069 A 3/2008
DE 3524439 A1 1/1987
FR 2 379 852 A1 9/1978
FR 2518296 5/1983
JP 63-307701 A 12/1988
JP 4-116341 U 10/1992
JP 6-4163 A 1/1994
JP 7-55033 A 3/1995
JP 3476848 B2 12/2003
JP 2012-204062 A 10/2012
JP 2013-108566 A 6/2013

* cited by examiner

OPERATION DEVICE AND WORKING MACHINE

CROSS-REFERENCE TO RELATED APPLICATIONS

The present application is a continuation application of International Application No. PCT/JP 2017/045781, filed Dec. 20, 2017, which claims priority to Japanese Patent Application No. 2016/250140, filed Dec. 22, 2016 and to Japanese Patent Application No. 2016/250141, filed Dec. 22, 2016. The contents of these applications are incorporated herein by reference in their entirety.

BACKGROUND OF THE INVENTION

Field of the Invention

The present invention relates to an operation device and to a working machine having the operation device.

Description of Related Art

An operation device for a working machine disclosed in Japanese Unexamined Patent Application Publication No. H07-55033 is previously known.

The operation device disclosed in Japanese Unexamined Patent Application Publication No. H07-55033 has a grip configured to be held by an operator, a universal joint configured to support the grip so as to be rotatable in an arbitrary rotation direction, and a lever shaft configured to connect the grip and the universal joint to each other.

SUMMARY OF THE INVENTION

An operation device according to one aspect of the present invention includes a grip to be grasped by an operator, and a supporting portion supporting the grip and allowing the grip to be turned in an arbitrary turning direction, and a rotation fulcrum of the grip is positioned inside the grip.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
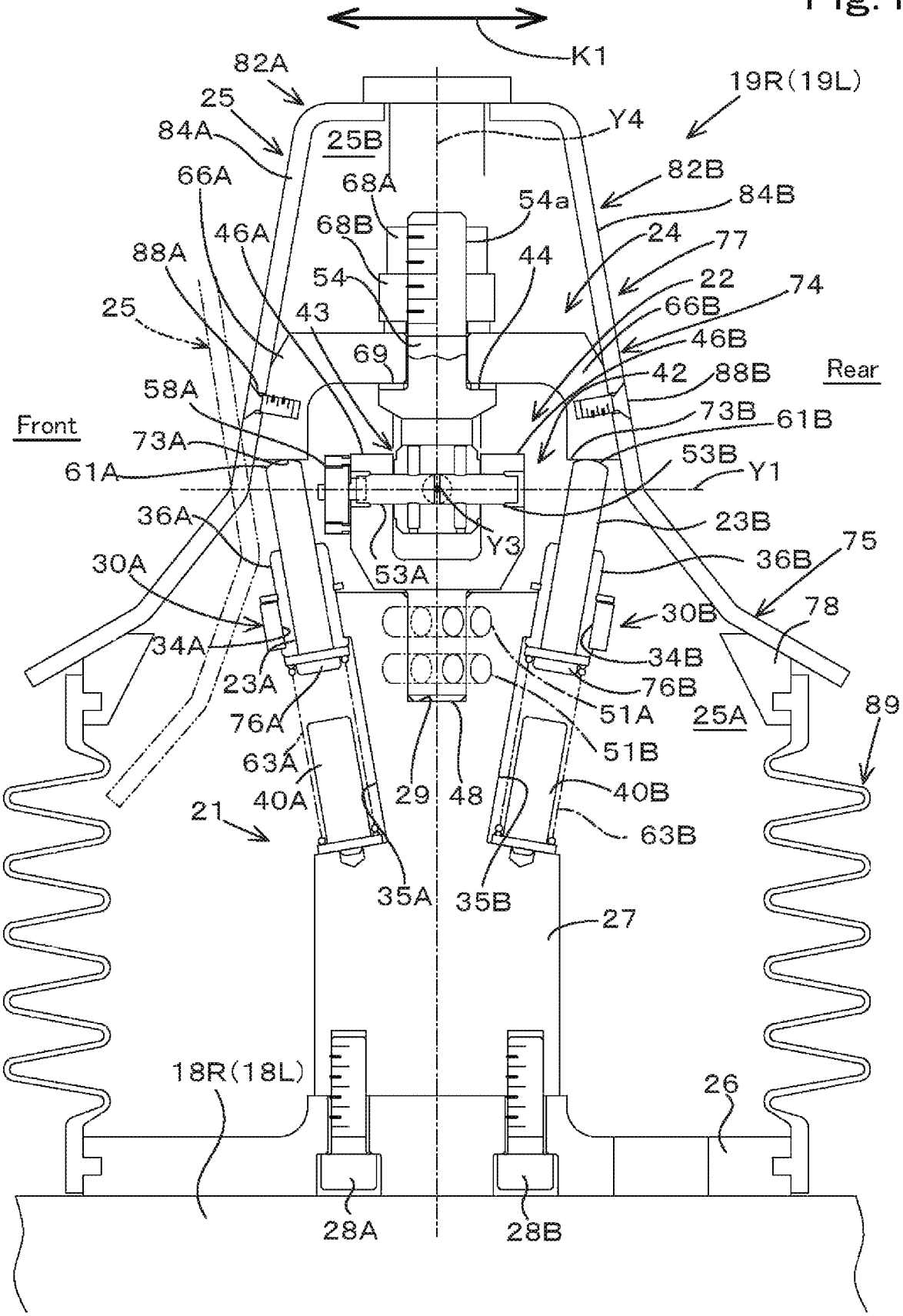
FIG. 1 is a cross-sectional view illustrating a left side surface of an operation device according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

With reference to the drawings, an embodiment of the present invention will be described below.

Figure 16:
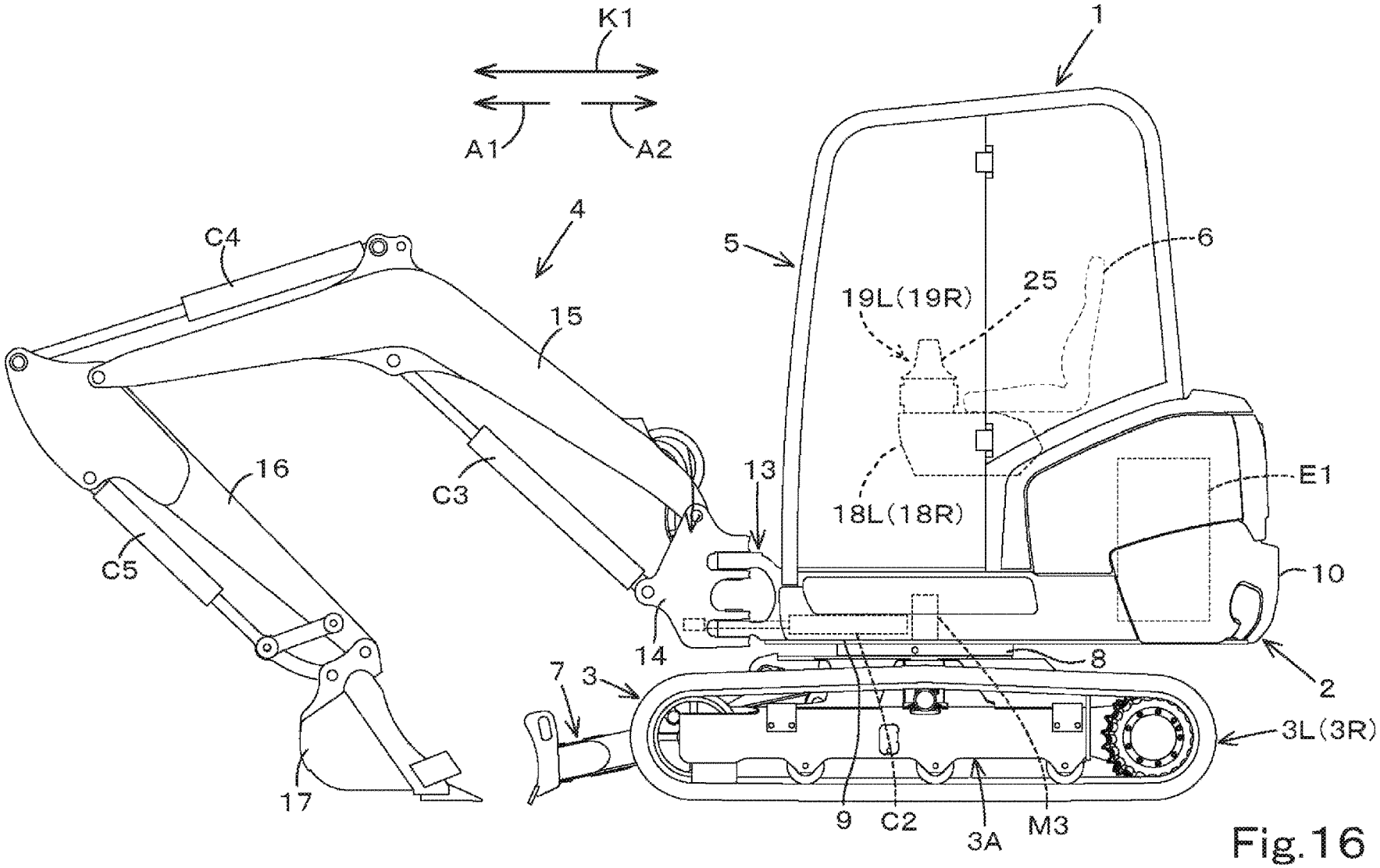
FIG. 16 is a schematic view illustrating a side surface of a working machine according to the embodiments.
Figure 17:
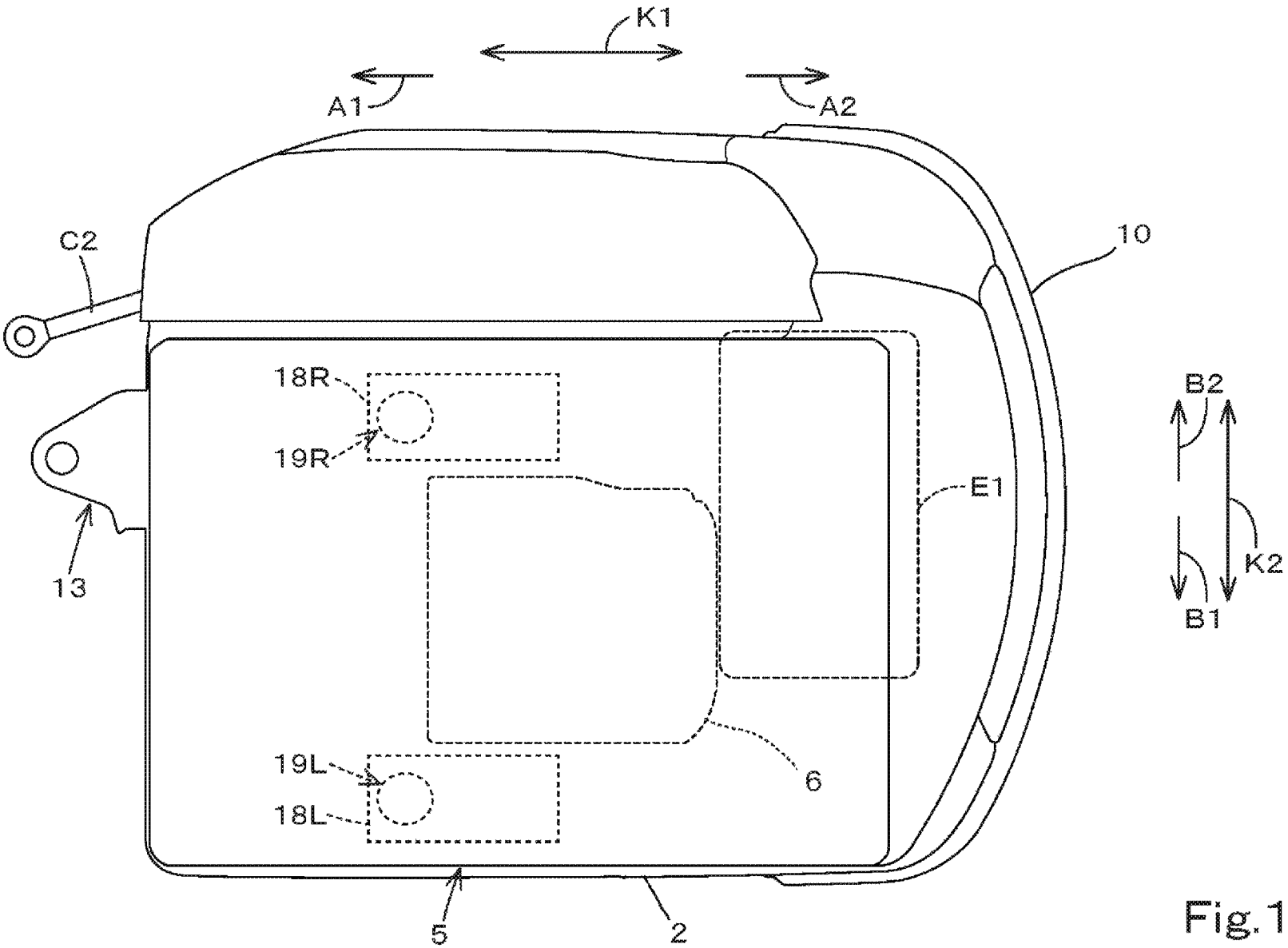
FIG. 17 is a schematic plan view illustrating a part of the working machine according to the embodiments.

FIG. 16 is a schematic side view showing an overall configuration of a working machine 1 according to the present embodiment. FIG. 17 is a schematic plan view of the working machine 1. In the present embodiment, a backhoe that is a swiveling working machine is exemplified as the working machine 1.

First, the overall configuration of the working machine 1 will be described below.

As shown in FIG. 16 and FIG. 17, the working machine 1 includes a machine body (a turn base) 2, a traveling device 3, and a working device 4. A cabin 5 is mounted on the machine body 2. In a room of the cabin 5, a driver seat (a seat) 6 on which a driver (an operator) is seated is provided.

In the embodiment of the present invention, the front side of the operator seated on the operator seat 6 of the working machine 1 (a direction of an arrowed line A1 in FIG. 16 and FIG. 17) is referred to as the front, the rear side of the operator (a direction of an arrowed line A2 in FIG. 16 and FIG. 17) is referred to as the rear, the left side of the operator (a front surface side of FIG. 16, a direction of an arrowed line B1 in FIG. 17) is referred to as the left, and the right side of the operator (a back surface side of FIG. 16, a direction of an arrowed line B2 in FIG. 17) is referred to as the right.

In addition, the horizontal direction that is a direction orthogonal to the front-rear direction K1 will be described as a machine width direction K2 (refer to FIG. 17) in the explanation. A direction from a center portion in the width direction of the machine body 2 toward the right portion or toward the left portion will be described as a machine outward direction in the explanation. In other words, the machine outward direction means a direction separating away from the center of the machine body 2 in the width direction, that is, the machine width direction K2. In the explanation, a direction opposite to the machine outward direction is referred to as the machine inward direction. In other words, the machine inward direction means a direction approaching the center of the machine body 2 in the machine width direction, that is, the machine width direction K2. In addition, the machine width direction K2 is the lateral direction of the machine body.

As shown in FIG. 16, the traveling device 3 includes a traveling frame 3A, a traveling device 3L provided on the left side of the traveling frame 3A, and a traveling device 3R provided on the right side of the traveling frame 3A. In the present embodiment, each of the traveling device 3L and the traveling device 3R is constituted of a traveling device of crawler type. In other words, the traveling device 3 is constituted of a crawler type traveling device.

A dozer device 7 is attached to a front portion of the traveling device 3. The dozer device 7 is configured to stretch and shorten a dozer cylinder (not shown in the drawings) and thereby to move a blade upward and downward (to raise and lower the blade).

The machine body 2 is supported on the traveling frame 3A by a turning bearing 8 so as to be rotatable around a vertical axis (an axis extending in a upward direction and a downward direction). The machine body 2 is driven to turn by a turning motor M3 constituted of a hydraulic motor (a hydraulic actuator). The machine body 2 has a weight 10 and a base plate (hereinafter referred to as a turning base plate) 9 configured to be turned around a vertical axis. The turning base plate 9 is formed of a steel plate or the like, and is connected to the turn bearing 8. The weight 10 is provided at a rear portion of the machine body 2. A prime mover E1 is mounted on the rear portion of the machine body 2. The prime mover E1 is constituted of a diesel engine. The prime mover E1 may be constituted of an electric motor, or may be a hybrid type having a diesel engine and an electric motor.

The machine body 2 has a support bracket 13 at a center of front portion of the machine body 2 slightly close to the right in the machine width direction K2. A swing bracket 14 is attached to the support bracket 13 so as to be swingable about the vertical axis. A working device 4 is attached to the swing bracket 14.

As shown in FIG. 16, the working device 4 has a boom 15, an arm 16, and a bucket (a working tool) 17. A base portion of the boom 15 is pivotally attached to the swing bracket 14 so as to be rotatable about a lateral axis (an axis extending in the machine width direction). In this manner, the boom 15 is configured to be freely swung upward and downward. The arm 16 is pivotally attached to a tip end side of the boom 15 so as to be rotatable about the lateral axis. In this manner, the arm 16 is configured to be freely swung back and forth or up and down. The bucket 17 is provided on the tip end side of the arm 16 so as to perform a shoveling operation and a dumping operation. Instead of or in addition to the bucket 17, it is possible for the working machine 1 to mount another working tool (a hydraulic attachment) configured to be driven by a hydraulic actuator. For example, the working tool may be a hydraulic breaker, a hydraulic crusher, an angle bloom, an earth auger, a pallet fork, a sweeper, a mower, or a snow blower.

The swing bracket 14 is configured to be swung by stretching and shortening of a swing cylinder C2 arranged in the machine body 2. The boom 15 is configured to be swung by stretching and shortening of a boom cylinder C3. The arm 16 is configured to be swung by stretching and shortening of an arm cylinder C4. The bucket 17 is configured to freely perform the shoveling operation and the dumping operation due to stretching and shortening of a bucket cylinder (a working tool cylinder) C5. Each of the dozer cylinder, the swing cylinder C2, the boom cylinder C3, the arm cylinder C4, and the bucket cylinder C5 is constituted of the hydraulic cylinder (the hydraulic actuators).

As shown in FIG. 17, an operation base 18L and an operation device 19L are arranged on the left side of the operator seat 6 in the cabin 5, the operation base 18L being fixed (supported) on the machine body 2, the operation device 19L being attached to the operation platform 18L. In addition, an operation base 18R and an operation device 19R are also arranged on the right side of the operator seat 6, the operation base 18R being fixed (supported) on the machine body 2, the operation device 19R being attached to the operation base 18R. Both of the operation device 19L and the operation device 19R are devices configured to operate two operation targets both mounted on the working machine 1.

For example, the operation device 19L is configured to operate the machine body 2 that is the first operation target, and is configured to operate the arm 16 that is the second operation target. In addition, the operation device 19R, for example, is configured to operate the bucket 17 that is the first operation target, and is configured to operate the boom 15 that is the second operation target.

In the present embodiment, the operation device 19L and the operation device 19R are arranged on the side of the operator seat 6, but the position of arrangement may be changed. For example, an operation base may be arranged in front of the operator seat 6, and the operation device 19L and the operation device 19R may be arranged side by side on the operation base in the machine width direction K2.

Next, the operation devices 19L and 19R will be described in detail below. Since the operation device 19L and the operation device 19R have substantially the same structure with each other, the operation device 19R will be explained, and then the explanation of the operation device 19L will be omitted.

FIG. 1 to FIG. 13 show one embodiment of the operation devices 19L and 19R.

Figure 2:
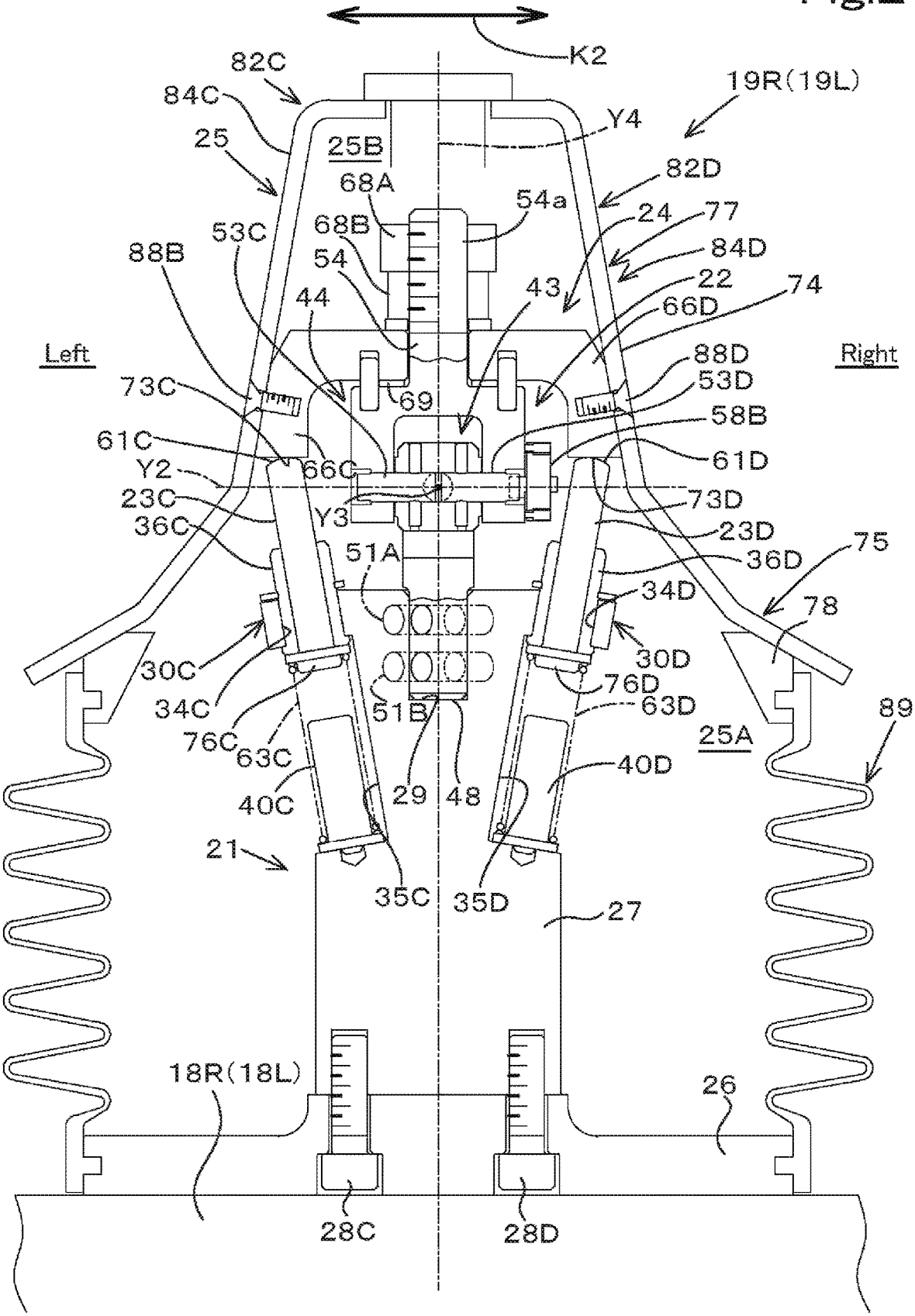
FIG. 2 is a cross-sectional view illustrating a back surface of the operation device according to the embodiment.

FIG. 1 is a cross section view illustrating a left side surface of the operation device 19R (19L). FIG. 2 is a cross section view illustrating a back surface of the operation device 19R (19L). As shown in FIG. 1 and FIG. 2, the operation device 19R (19L) includes a base 21, a supporting portion 22, a plurality of push rods 23A to 23D, a swing body 24, and a grip 25. The base 21 is attached to the operation base 18R (18L). The supporting portion 22 is attached to the base 21. The plurality of push rods 23A to 23D are arranged on the base 21. The swing body 24 is attached to the supporting portion 22. The grip 25 is attached to the swing body 24.

As shown in FIG. 1 and FIG. 2, the base 21 has a base portion 26 and a main body portion 27 provided standing on the base portion 26. The base portion 26 is fixed by a bolt to the operation base 18R (18L). The main body portion 27 is fixed to the base portion 26 by bolts 28A to 28D. The main body portion 27 has a fitting hole 29 and a plurality of attachment portions 30A to 30D at the upper portion of the main body portion 27.

Figure 3:
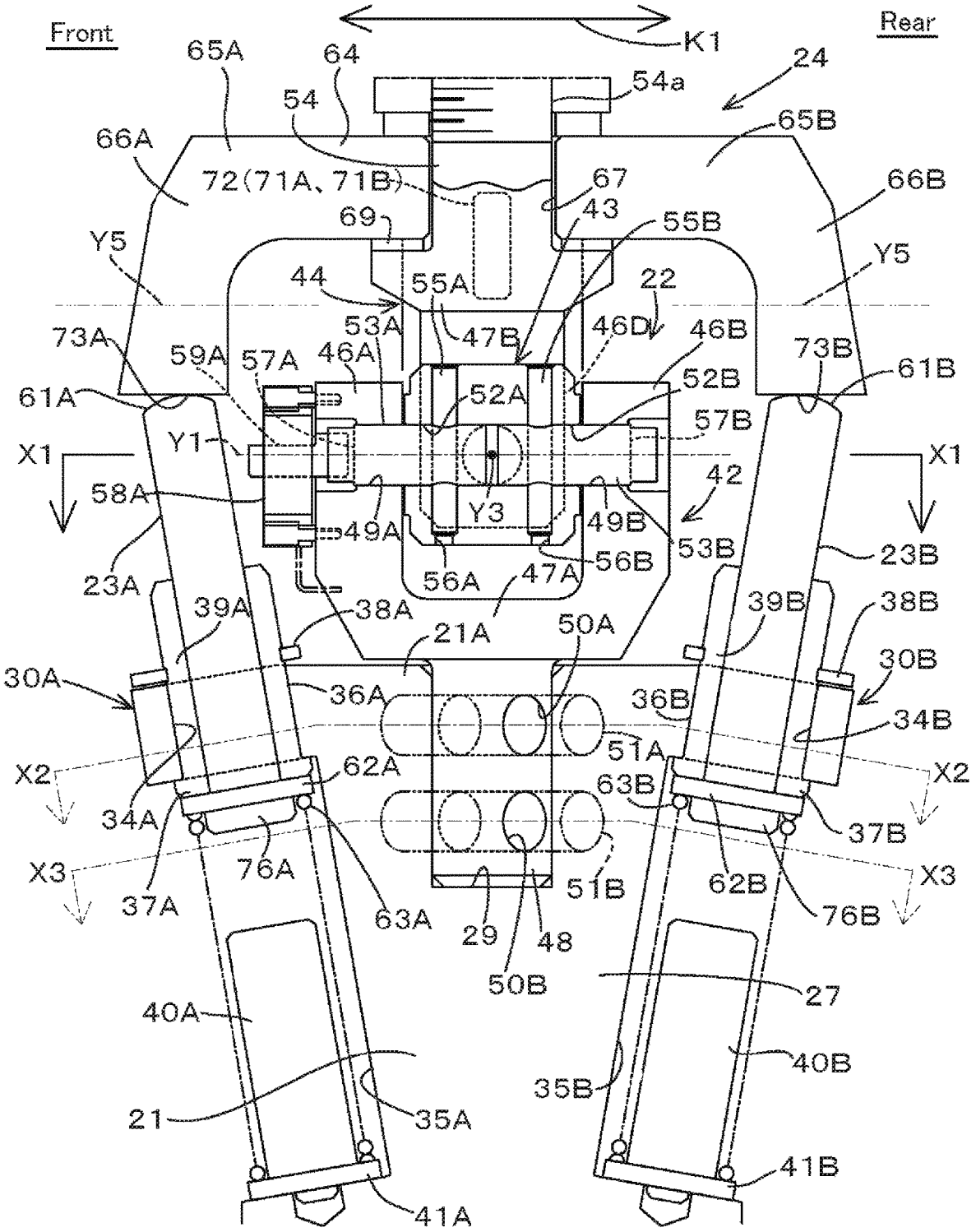
FIG. 3 is a cross-sectional view illustrating a right side surface of a main portion of the operation device according to the embodiment.
Figure 4:
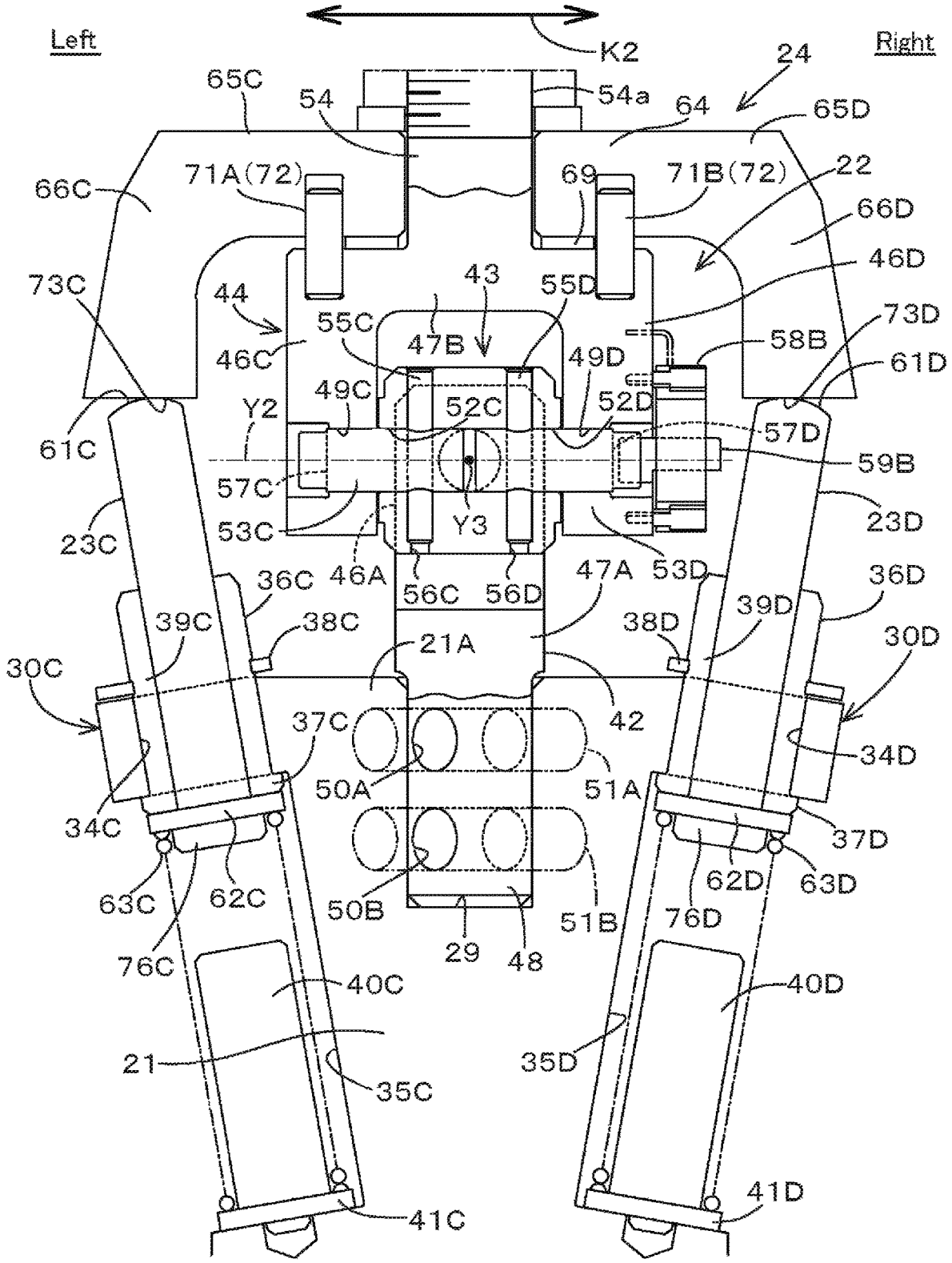
FIG. 4 is a cross-sectional view illustrating a back surface of the main portion of the operation device according to the embodiment.
Figure 6A:
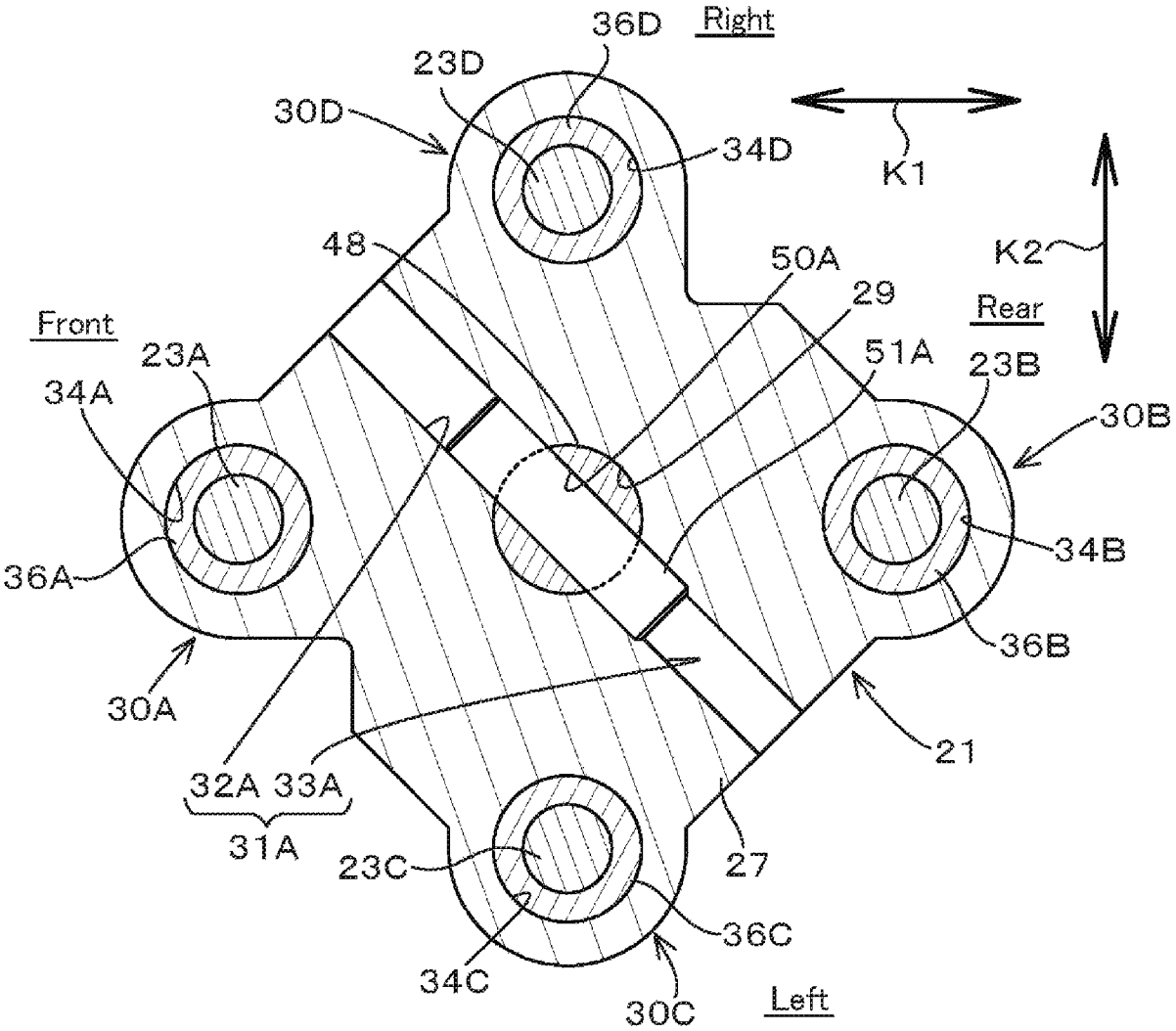
FIG. 6A is a cross-sectional view of FIG. 3 in X2-X2 arrowed lines.
Figure 6B:
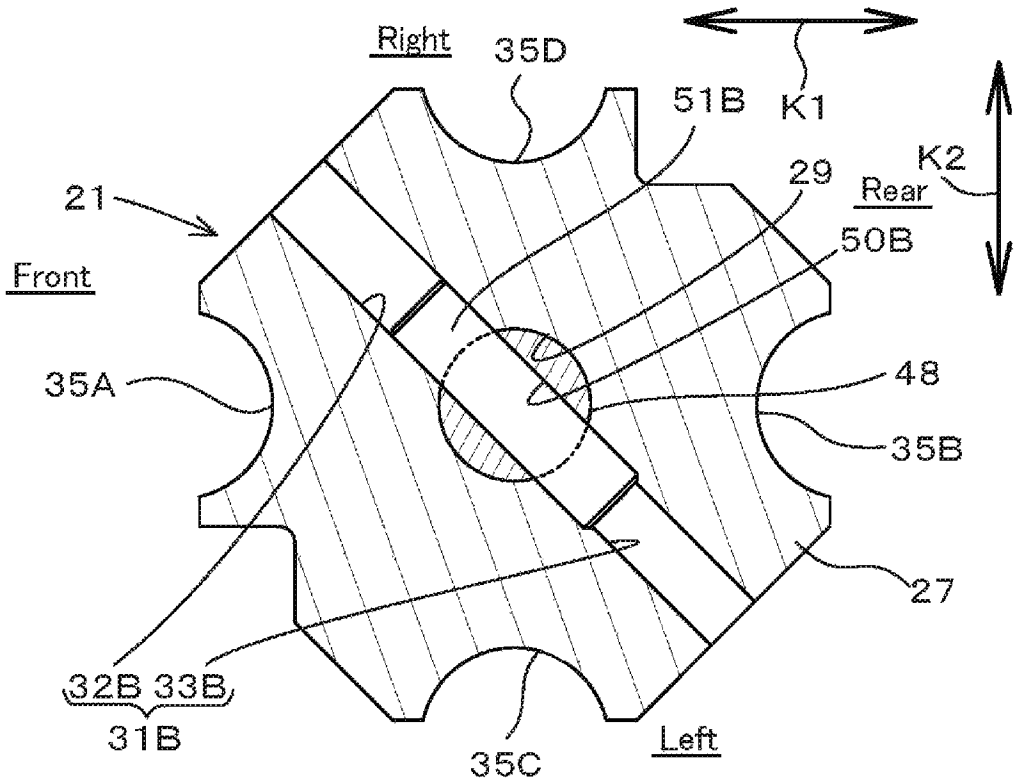
FIG. 6B is a cross-sectional view of FIG. 3 in X3-X3 arrowed lines.

As shown in FIG. 3 and FIG. 4, the fitting hole 29 is formed of a bottomed columnar circumferential surface, which is formed so as to be recessed downward from the upper surface of the main body portion 27. That is, the base 21 has a fitting hole 29 formed on the upper surface of the base 21. As shown in FIG. 6A and FIG. 6B, the fitting hole 29 is located at the center portion of the main body portion 27. Meanwhile, it should be noted that the fitting hole 29 may be formed penetrating through the base 21.

As shown in FIG. 6A and FIG. 6B, first pin holes 31A and 31B penetrating through the main body portion 27 (the base 21) across the fitting hole 29 are formed on the upper portion of the main body portion 27. Each of the first pin holes 31A and 31B is formed of an annular edge portion (a circumferential surface) that is formed penetrating through the main body portion 27. In the present embodiment, two of the first pin holes 31A and 31B are formed. Two of the first pin holes 31A and 31B are formed being arranged parallel to each other and side by side in the vertical direction. Meanwhile, it is required for at least one of the first pin holes 31A and 31B to be provided.

As shown in FIG. 6A and FIG. 6B, each of the first pin holes 31A and 31B is formed so as to extend in an oblique direction between the front-rear direction K1 and the machine width direction K2. Each of the first pin holes 31A and 31B is formed in a stepped shape whose diameter is reduced behind the fitting hole 29. That is, each of the first pin holes 31A and 31B has a large diameter portions 32A and 32B on the front portion side, and has a small diameter portions 33A and 33B on the rear portion side, the large diameter portions 32A and 32B having diameters smaller than the diameters of the large diameter portions 32A and 32B. The large diameter portions 32A and 32B are formed across the fitting hole 29 from the front portion of the main body portion 27.

As shown in FIG. 1 to FIG. 4 and FIG. 6A, the plurality of attachment portions 30A to 30D include the first attachment portion 30A, the second attachment portion 30B, the third attachment portion 30C, and the fourth attachment portion 30D. The first attachment portion 30A is provided at the front portion of the main body portion 27 (of the base 21). The second attachment portion 30B is provided at the rear portion of the main body portion 27 (of the base 21). The third attachment portion 30C is provided at the left portion of the main body portion 27 (of the base 21). The fourth attachment portion 30D is provided at the right portion of the main body portion 27 (of the base 21).

Supporting holes 34A to 34D are respectively formed in the attachment portions 30A to 30D. Each of the supporting holes 34A to 34D is formed of an annular edge portion (a circumferential surface) formed penetrating through the attachment portions 30A to 30D in the vertical direction. The supporting hole formed in the first attachment portion 30A is referred to as a first supporting hole 34A. The supporting hole formed in the second attachment portion 30B is referred to as a second supporting hole 34B. The supporting hole formed in the third attachment portion 30C is referred to as a third supporting hole 34C. The supporting hole formed in the fourth attachment portion 30D is referred to as a fourth supporting hole 34D. The first supporting hole 34A has an axis extending upward in an inclined direction that gradually shifts forward. The second supporting hole 34B has an axis extending upward in an inclined direction that gradually shifts backward. The third supporting hole 34C has an axis extending upward in an inclined direction that gradually shifts leftward (in the machine inward direction). The fourth supporting hole 34D has an axis extending upward in an inclined direction that gradually shifts rightward (in the machine outward direction).

As shown in FIG. 1 to FIG. 4 and FIG. 6B, the main body portion 27 has concave portions 35A to 35D respectively formed below the attachment portions 30A to 30D. The concave portion formed at a position corresponding to the lower side of the first attachment portion 30A is referred to as a first concave portion 35A. The concave portion formed at a position corresponding to the lower side of the second attachment portion 30B is referred to as a second concave portion 35B. The concave portion formed at a position corresponding to the lower side of the third attachment portion 30C is referred to as a third concave portion 35C. The concave portion formed at a position corresponding to the lower side of the fourth attachment portion 30D is referred to as a fourth concave portion 35D. Each of the concave portions 35A to 35D is provided being recessed from the outer surface of the base 21 toward the center. In addition, each of the concave portions 35A to 35D is formed of a groove having a semicircular arc-shaped cross section that is vertically elongated from a middle portion of the main body portion 27 in the vertical direction to the attachment portions 30A to 30D.

As shown in FIG. 1 and FIG. 3, the first concave portion 35A extends in the inclined direction same as the inclined direction of the axis of the first supporting hole 34A, and one end surface (an upper surface) is communicated with the first supporting hole 34A. The second concave portion 35B extends in the inclined direction same as the inclined direction of the axis of the second supporting hole 34B, and one end surface (an upper surface) is communicated with the second supporting hole 34B.

As shown in FIG. 2 and FIG. 4, the third concave portion 35C extends in the inclined direction same as the inclined direction of the axis of the third supporting hole 34C, and one end surface (an upper surface) is communicated with the third supporting hole 34C. The fourth concave portion 35D extends in the inclined direction same as the inclined direction of the axis of the fourth supporting hole 34C, and one end surface (an upper surface) is communicated with the fourth supporting hole 34D.

Sleeves 36A to 36D are inserted into the supporting holes 34A to 34D from the lower side (the concave portion side). The sleeve inserted into the first supporting hole 34A is referred to as a first sleeve 36A. The sleeve inserted into the second supporting hole 34B is referred to as a second sleeve 36B. The sleeve inserted into the third supporting hole 34C is referred to as a third sleeve 36C. The sleeve inserted into the fourth supporting hole 34D is referred to as a fourth sleeve 36D.

As shown in FIG. 3, the first sleeve 36A extends in the inclined direction same as the inclined direction of the axis of the first supporting hole 34A. A lower portion of the first sleeve 36A is provided with a retaining portion 37A (referred to as a first retaining portion) that contacts to the lower surface (an attachment portion) of the first attachment portion 30A so as to prevent the first sleeve 36A from slipping off upward from the first supporting hole 34A. In addition, the upper portion of the first sleeve 36A is provided with a retaining ring attachment portion (referred to as a first retaining ring attachment portion) 39A to which a retaining ring (referred to as a first retaining ring) 38A is attached so as to prevent the first sleeve 36A from slipping off upward from the first supporting hole 34A. In this manner, the first sleeve 36A is assembled to the first attachment portion 30A.

As shown in FIG. 3, the second sleeve 36B extends in the inclined direction same as the inclined direction of the axis of the second supporting hole 34B. A lower portion of the second sleeve 36B is provided with a retaining portion 37B (referred to as a second retaining portion) that contacts to the lower surface (an attachment portion) of the second attachment portion 30B so as to prevent the second sleeve 36B from slipping off upward from the second supporting hole 34B. In addition, the upper portion of the second sleeve 36B is provided with a retaining ring attachment portion (referred to as a second retaining ring attachment portion) 39B to which a retaining ring (referred to as a second retaining ring) 38B is attached so as to prevent the second sleeve 36B from slipping off upward from the second supporting hole 34B. In this manner, the second sleeve 36B is assembled to the second attachment portion 30B.

As shown in FIG. 4, the third sleeve 36C extends in the inclined direction same as the inclined direction of the axis of the third supporting hole 34C. A lower portion of the third sleeve 36C is provided with a retaining portion 37C (referred to as a third retaining portion) that contacts to the lower surface (an attachment portion) of the third attachment portion 30C so as to prevent the third sleeve 36C from slipping off upward from the third supporting hole 34C. In addition, the upper portion of the third sleeve 36C is provided with a retaining ring attachment portion (referred to as a third retaining ring attachment portion) 39C to which a retaining ring (referred to as a third retaining ring) 38C is attached so as to prevent the third sleeve 36C from slipping off upward from the third supporting hole 34C. In this manner, the third sleeve 36C is assembled to the third attachment portion 30C.

As shown in FIG. 4, the fourth sleeve 36D extends in the inclined direction same as the inclined direction of the axis of the fourth supporting hole 34D. A lower portion of the fourth sleeve 36D is provided with a retaining portion 37D (referred to as a fourth retaining portion) that contacts to the lower surface (an attachment portion) of the fourth attachment portion 30D so as to prevent the fourth sleeve 36D from slipping off upward from the fourth supporting hole 34D. In addition, the upper portion of the fourth sleeve 36D is provided with a retaining ring attachment portion (referred to as a fourth retaining ring attachment portion) 39D to which a retaining ring (referred to as a fourth retaining ring) 38D is attached so as to prevent the fourth sleeve 36D from slipping off upward from the fourth supporting hole 34D. In this manner, the fourth sleeve 36D is assembled to the fourth attachment portion 30D.

As shown in FIG. 1 and FIG. 2, stoppers 40A to 40D are respectively provided below the attachment portions 30A to 30D (below the sleeves 36A to 36D). The stopper below the first attachment portion 30A (the first sleeve 36A) is referred to as a first stopper 40A. The stopper below the second attachment portion 30B (the second sleeve 36B) is referred to as a second stopper 40B. The stopper below the third attachment portion 30C (the third sleeve 36C) is referred to as a third stopper 40C. The stopper below the fourth attachment portion 30D (the fourth sleeve 36D) is referred to as a fourth stopper 40D.

As shown in FIG. 3, the first stopper 40A extends in the inclined direction same as the inclined direction of the axis of the first supporting hole 34A. The first stopper 40A is arranged at a lower portion in the first concave portion 35A with a distance from the first sleeve 36A. The first stopper 40A is fixed to the other end face (a lower face) of the first concave portion 35A. A lower portion of the first stopper 40A is provided with a spring accepting portion (a first spring accepting portion) 41A.

As shown in FIG. 3, the second stopper 40B extends in the inclined direction same as the inclined direction of the axis of the second supporting hole 34B. The second stopper 40B is arranged at a lower portion in the second concave portion 35B with a distance from the second sleeve 36B. The second stopper 40B is fixed to the other end face (a lower face) of the second concave portion 35B. A lower portion of the second stopper 40B is also provided with a spring accepting portion (a second spring accepting portion) 41B.

As shown in FIG. 4, the third stopper 40C extends in the inclined direction same as the inclined direction of the axis of the third supporting hole 34C. The third stopper 40C is arranged at a lower portion in the third concave portion 35C with a distance from the third sleeve 36C. The third stopper 40C is fixed to the other end face (a lower face) of the third concave portion 35C. A lower portion of the third stopper 40C is also provided with a spring accepting portion (a third spring accepting portion) 41C.

As shown in FIG. 4, the fourth stopper 40D extends in the inclined direction same as the inclined direction of the axis of the fourth supporting hole 34D. The fourth stopper 40D is arranged at a lower portion in the fourth concave portion 35D with a distance from the fourth sleeve 36D. The fourth stopper 40D is fixed to the other end face (a lower face) of the fourth concave portion 35D. A lower portion of the fourth stopper 40D is also provided with a spring accepting portion (a fourth spring accepting portion) 41D.

Figure 7:
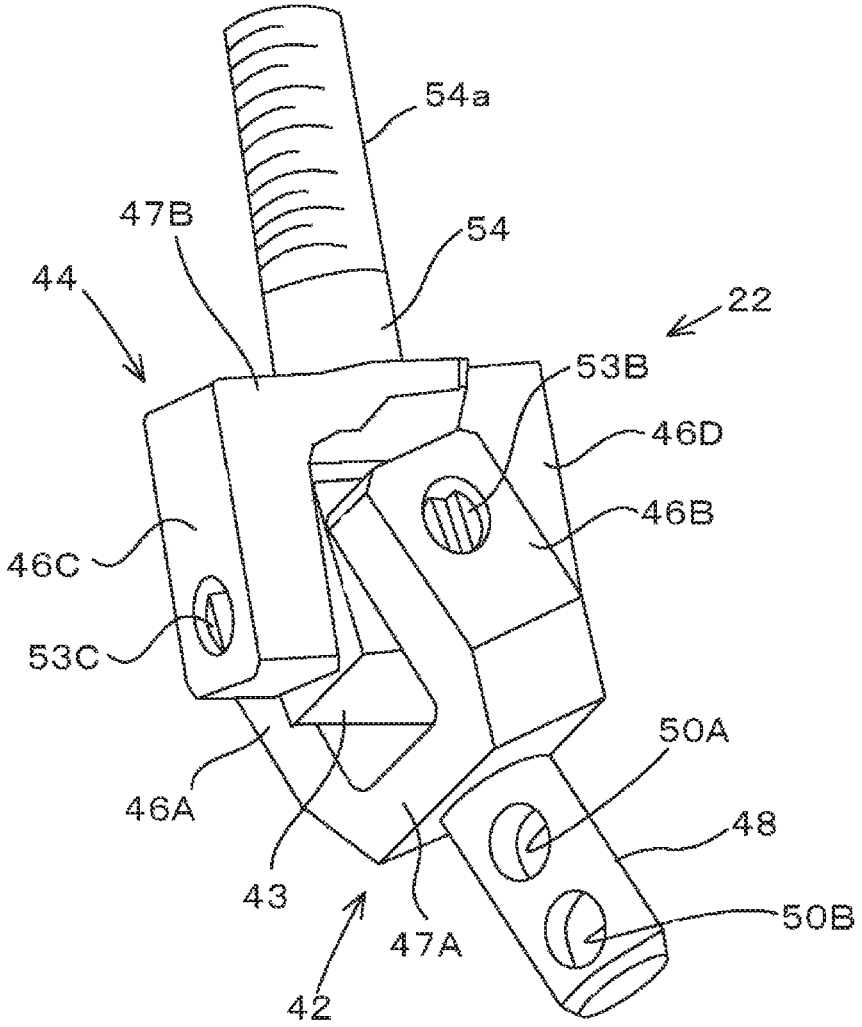
FIG. 7 is a perspective view illustrating a supporting portion according to the embodiment.

As shown in FIG. 1. FIG. 2, and FIG. 7, the supporting portion 22 is constituted of a universal joint structure (a universal coupler), and is configured to support the grip 25 so as to be rotatable in an arbitrary rotational direction. The supporting portion 22 includes a first yoke 42, a coupling body 43, and a second yoke 44.

As shown in FIG. 3, the first yoke 42 has a first coupling portion 46A, a second coupling portion 46B, a first connecting portion 47A, and an attachment portion 48. The first coupling portion 46A is positioned in front of the fitting hole 29. The second coupling portion 46B is positioned behind the fitting hole 29. The first coupling portion 46A and the second coupling portion 46B are provided to face each other with a clearance in the front-rear direction K1. The first connecting portion 47A connects the lower portion of the first coupling portion 46A and the lower portion of the second coupling portion 46B to each other.

As shown in FIG. 3, a first shaft hole 49A is formed in the first coupling portion 46A. The first shaft hole 49A is formed of an annular edge portion (a circumferential surface) that is formed penetrating through the first coupling portion 46A in the front-rear direction K1. The first shaft hole 49A has an axis extending in the front-rear direction K1. A second shaft hole 49B is formed in the second coupling portion 46B. The second shaft hole 49B is formed of an annular edge portion (a circumferential surface) that is formed penetrating through the second coupling portion 46B in the front-rear direction K1. The second shaft hole 49B has an axis extending in the front-rear direction K1. That is, the axial center of the second axial hole 49B is concentric with the axial center of the first axial hole 49A.

As shown in FIG. 3 and FIG. 4, the attachment portion 48 protrudes downward from the lower surface of the first connecting portion 47A. The attachment portion 48 is formed in a bar shape that extends in the vertical direction. In other words, the attachment portion 48 is formed in a columnar shape that has an axis extending in the vertical direction. The attachment portion 48 is inserted into the fitting hole 29 from above, and is fitted to the fitting hole 29. That is, the operation device 19R (19L) has the first yoke 42 fitted to the base 21.

In addition, second pin holes 50A and 50B penetrating through the attachment portion 48 in the radial direction are formed in the attachment portion 48. The second pin holes 50A and 50B are formed of an annular edge portion (a circumferential surface) that is formed penetrating through the attachment portion 48. In the present embodiment, two of the second pin holes 50A and 50B are formed. Two of the second pin holes 50A and SOB are formed being arranged parallel to each other and side by side in the vertical direction. Meanwhile, it is required for at least one of the second pin holes 50A and 50B to be provided, and the provided number of the second pin holes 50A and 50B corresponds to the number of the first pin holes 31A and 31B.

As shown in FIG. 6A, the second pin hole 50A on the upper side can be coaxially communicated with the first pin hole 31A on the upper side under a state where the attachment portion 48 is fitted to the fitting hole 29. That is, when the attachment portion 48 is fitted to the fitting hole 29, the second pin hole 50A is communicated with the first pin hole 31A. In addition, the base 21 is provided with a fixing member 51A to be inserted through the first pin hole 31A and the second pin hole 50A. That is, the fixing member 51A is a member that is inserted through the base 21 and the first yoke 42 fitted to the base 21 and thereby fixes the first yoke 42 to the base 21. In addition, the fixing member 51A is a pin to be inserted through the first pin hole 31A and the second pin hole 50A.

As shown in FIG. 6B, the second pin hole 50B on the lower side can be coaxially communicated with the first pin hole 31B on the lower side under a state where the attachment portion 48 is fitted to the fitting hole 29. That is, when the attachment portion 48 is fitted to the fitting hole 29, the second pin hole 50B is communicated with the first pin hole 31B. In addition, the base 21 is provided with a fixing member 51B to be inserted through the first pin hole 31B and the second pin hole 50B. That is, the fixing member 51B is a member that is inserted through the base 21 and the first yoke 42 fitted to the base 21 and thereby fixes the first yoke 42 to the base 21. In addition, the fixing member 51B is a pin to be inserted through the first pin hole 31B and the second pin hole 50B.

As shown in FIG. 3 and FIG. 4, the first yoke 42 is fixed to the base 21 (the machine body 2) constantly in a fixed orientation by the fixing member 51A and the fixing member 51B. The upper portion of the base 21 is a fixing portion 21A to which the supporting portion 22 of the base 21 is attached.

Figure 5:
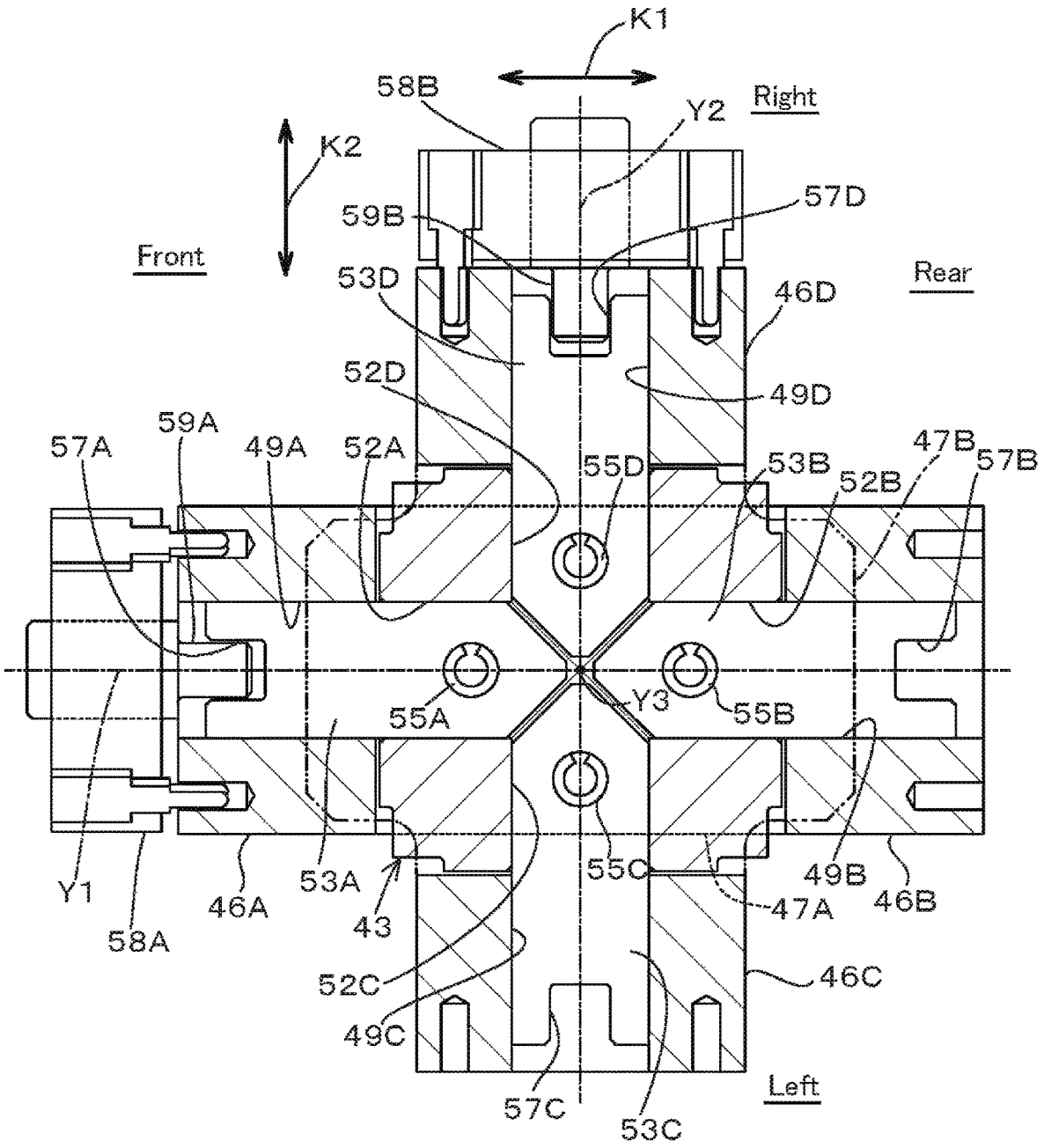
FIG. 5 is a cross-sectional view of FIG. 3 in X1-X1 arrowed lines.

As shown in FIG. 3, FIG. 4, and FIG. 5, the coupling body 43 is formed in a rectangular block shape, and is arranged between the first coupling portion 46A and the second coupling portion 46B. The coupling body 43 has a first shaft insertion hole 52A, a second shaft insertion hole 52B, a third shaft insertion hole 52C, and a fourth shaft insertion hole 52D. The first shaft insertion hole 52A is coaxially communicated with the first shaft hole 49A. The second shaft insertion hole 52B is coaxially communicated with the second shaft hole 49B. The first shaft insertion hole 52A is formed of an annular edge portion (a circumferential surface) formed from the front surface of the coupling body 43 toward the center of the coupling body 43. The second shaft insertion hole 52B is coaxially communicated with the second shaft hole 49B. The second shaft insertion hole 52B is formed of an annular edge portion (a circumferential surface) formed from the front surface of the coupling body 43 toward the center of the coupling body 43. The second shaft insertion hole 52B is coaxially communicated with the second shaft hole 49B. The third shaft insertion hole 52C is formed of an annular edge portion (a circumferential surface) formed from the side surface on the left (the machine inward direction) of the coupling body 43 toward the center of the coupling body 43. The fourth shaft insertion hole 52D is formed of an annular edge portion (a circumferential surface) formed from the side surface on the right (the machine outward direction) of the coupling body 43 toward the center of the coupling body 43.

As shown in FIG. 4, the second yoke 44 has a third coupling portion 46C, a fourth coupling portion 46C, a second connecting portion 47B, and an attachment shaft 54. The third coupling portion 46C is positioned on the left side of the coupling body 43 (in the machine inward direction). The fourth coupling portion 46D is positioned on the right side of the coupling body 43 (in the machine outward direction). That is, the third coupling portion 46C and the fourth coupling portion 46D are provided to be opposed to each other with a clearance therebetween in the machine width direction K2, and the coupling body 43 is arranged between the third coupling portion 46C and the fourth coupling portion 46D. The second connecting portion 47B connects the upper portion of the third coupling portion 46C and the upper portion of the fourth coupling portion 46D to each other.

As shown in FIG. 4, a third shaft hole 49C is formed in the third coupling portion 46C. The third shaft hole 49C is formed of an annular edge portion (a circumferential surface) that is formed penetrating through the third coupling portion 46C in the machine width direction K2. The third shaft hole 49C has an axis extending in the machine width direction K2. The third shaft hole 49C is communicated coaxially with the third shaft insertion hole 52C. A fourth shaft hole 49D is formed in the fourth coupling portion 46D. The fourth shaft hole 49D is formed of an annular edge portion (a circumferential surface) that is formed penetrating through the fourth coupling portion 46D in the machine width direction K2. The fourth shaft hole 49D has an axis extending in the machine width direction K2. The fourth shaft hole 49D is communicated coaxially with the fourth shaft insertion hole 52D. The axial center of the fourth axial hole 49D is concentric with the axial center of the third axial hole 49C.

As shown in FIG. 1 and FIG. 2, the attachment shaft 54 protrudes upward from the upper surface of the second connecting portion 47B. That is, the attachment shaft 54 protrudes from the second yoke 44. A screw portion (an external thread) 54*a* is formed on the upper portion (a tip end side) of the attachment shaft 54.

As shown in FIG. 5, a first shaft member 53A is inserted through the first shaft hole 49A and the first shaft insertion hole 52A. That is, the first yoke 42 has a first coupling portion 46A that is rotatably connected to the coupling body 43 by the first shaft member 53A. In addition, a second shaft member 53B is inserted through the second shaft hole 49B and the second shaft insertion hole 52B. That is, the first yoke 42 has the second coupling portion 46B that is rotatably connected to the coupling body 43 by the second shaft member 53B. The first shaft member 53A and the second shaft member 53B have a first axis Y1 shared therewith. In other words, the first shaft member 53A and the second shaft member 53B are arranged on the first axis Y1. In addition, the first axis Y1 is substantially parallel (substantially coincides) with the front-rear direction K1 of the operator seat (the seat) 6 on which an operator to operate the grip 25 is seated. That is, the first axis Y1 is an axis extending in the front-rear direction K1.

As shown in FIG. 5, the third shaft member 53C is inserted through the third shaft hole 49C and the third shaft insertion hole 52C. That is, the second yoke 44 has a third coupling portion 46C that is rotatably connected to the coupling body 43 by the third shaft member 53C. In addition, the fourth shaft member 53D is inserted through the fourth shaft hole 49D and the fourth shaft insertion hole 52D. That is, the second yoke 44 has a fourth coupling portion 46D that is rotatably connected to the coupling body 43 by the fourth shaft member 53D. The third shaft member 53C and the fourth shaft member 53D have a second axis Y2 shared therewith. In other words, the third shaft member 53C and the fourth shaft member 53D are arranged on the second axis Y2. In addition, the second axis Y2 is substantially parallel (substantially coincident) with the horizontal direction (the machine width direction K2) orthogonal to the front-rear direction K1. That is, the second axis Y2 is an axis different from the first axis Y1, and extends in the machine direction K2.

As shown in FIG. 3, the coupling body 43 is provided with a first retaining pin 55A that is to be struck over the coupling body 43 and the first shaft member 53A. That is, the first shaft member 53A is fixed to the coupling body 43 by the pin. In addition, the coupling body 43 is provided with a second retaining pin 55B that is to be struck over the coupling body 43 and the second shaft member 53B. That is, the second shaft member 53B is fixed to the coupling body 43 by the pin. The first coupling portion 46A is configured to rotate around the first axis Y1 relatively with respect to the first shaft member 53A. The second coupling portion 46B is configured to rotate around the first axis Y1 relatively with respect to the second shaft member 53B. As described above, the first shaft member 53A and the second shaft member 53B integrally rotate around the first axis Y1 together with the coupling body 43. In addition, the coupling body 43 is connected to the first yoke 42 so as to be rotatable about the first axis Y1 by the first shaft member 53A and the second shaft member 53B.

As shown in FIG. 4, the coupling body 43 is provided with a third retaining pin 55C to be struck over the coupling body 43 and the third shaft member 53C. That is, the third shaft member 53C is fixed to the coupling body 43 by the pin. In addition, the coupling body 43 is provided with a fourth retaining pin 55D to be struck over the coupling body 43 and the fourth shaft member 53D. That is, the fourth shaft member 53D is fixed to the coupling body 43 by the pin. The third coupling portion 46C is rotatable about the second axis Y2 relatively with respect to the third shaft member 53C. The fourth coupling portion 46D is rotatable about the second axis Y2 relatively with respect to the fourth shaft member 53D. As described above, the third shaft member 53C and the fourth shaft member 53D integrally rotate about the second axis Y2 together with the coupling body 43. In addition, the second yoke 44 is connected to the coupling body 43 by the third shaft member 53C and the fourth shaft member 53D so as to be rotatable about the second axis Y2.

The point of intersection between the first axis Y1 and the second axis Y2 is the rotational fulcrum (a rotation center) Y3 of the grip 25 (see FIG. 5).

As shown in FIG. 3, the first retaining pin 55A is struck into the coupling body 43 from the upper surface of the coupling body 43. A disassembly hole 56A into which a tool for pulling upward the first retaining pin 55A is inserted is formed below the first retaining pin 55A. In addition, the second retaining pin 55B is struck into the coupling body 43 from the upper surface of the coupling body 43. A disassembly hole 56B into which a tool for pulling upward the second retaining pin 55B is inserted is formed below the second retaining pin 55B.

As shown in FIG. 4, the third retaining pin 55C is struck into the coupling body 43 from the upper surface of the coupling body 43. A disassembly hole 56A into which a tool for pulling upward the third retaining pin 55C is inserted is formed below the third retaining pin 55C. In addition, the fourth retaining pin 55D is struck into the coupling body 43 from the upper surface of the coupling body 43. A disassembly hole 56D into which a tool for pulling upward the fourth retaining pin 55D is inserted is formed below the fourth retaining pin 55D.

As shown in FIG. 5, a slit groove 57A extending in the radial direction is provided on one end portion (a front end portion) of the first shaft member 53A. The other end portion (a rear end portion) of the first shaft member 53A is tapered toward the second shaft member 53B (rearward) in a plan view. In the present embodiment, the surface of the other end portion of the first shaft member 53A on the machine outward side and the surface on the machine inward side are cut at an angle of 45°. In addition, a slit groove 57B extending in the radial direction is also provided on one end portion (a rear end portion) of the second shaft member 53B. The other end portion (a rear end portion) of the second shaft member 53B is tapered toward the first shaft member 53A (forward) in a plan view. In the present embodiment, the surface of the other end portion of the second shaft member 53B on the machine outward side and the surface on the machine inward side are cut at an angle of 45°.

As shown in FIG. 5, a slit groove 57C extending in the radial direction is also provided on one end portion (the end portion on the machine inward side) of the third shaft member 53C. The other end portion (the end portion on the machine outward side) of the third shaft member 53C is tapered toward the fourth shaft member 53D (the machine outward side) in a plan view. In the present embodiment, the front surface and rear surface of the other end portion of the third shaft member 53C are cut at an angle of 45°. In addition, a slit groove 57D extending in the radial direction is also provided on one end portion (the end portion on the machine outward side) of the fourth shaft member 53D. The other end portion (the end portion on the machine inward side) of the fourth shaft member 53D is tapered toward the third shaft member 53C (the machine inward side) in a plan view. In the present embodiment, the front surface and rear surface of the other end portion of the fourth shaft member 53D are cut at an angle of 45°.

The other end portion of the first shaft member 53A, the other end portion of the second shaft member 53B, the other end portion of the third shaft member 53C, and the other end portion of the fourth shaft member 53D are arranged facing each other as shown in FIG. 5, thereby the positioning in the rotational direction about the axis center is defined, and thus the orientations of the slit grooves 57A to 57D are defined.

As shown in FIG. 3 and FIG. 5, a detection device 58A (referred to as a first detection device) is provided on the front surface of the first coupling portion 46A. A detection element 59A of the first detection device 58A is engaged with the slit groove 57A of the first shaft member 53A, and is configured to rotate integrally with the first shaft member 53A. The first detection device 58A is an angle detector configured to detect rotation of the coupling body 43 (the grip 25) around the first axis Y1. In other words, the first detection device 58A is a potentiometer configured to detect an angle of operation of the grip 25.

Meanwhile, the first detection device 58A may be provided on the rear surface of the second coupling portion 46B. In that case, the detection element 59A of the first detection device 58A is engaged with the slit groove 57B of the second shaft member 53B. In addition, the first detection device 58A may be provided on both of the front surface of the first coupling portion 46A and the rear surface of the second coupling portion 46B.

As shown in FIG. 4 and FIG. 5, a detection device (referred to as a second detection device) 58B is provided on the machine outward side of the fourth coupling portion 46D. A detection element 59B of the second detection device 58B engages with the slit groove 57D of the fourth shaft member 53D, and is configured to rotate integrally with the fourth shaft member 53D. The second detection device 58B is an angle detector configured to detect rotation of the second yoke 44 (the grip 25) about the second axis Y2. In other words, the second detection device 58B is a potentiometer configured to detect an angle of operation of the grip 25.

Meanwhile, the second detection device 58B may be provided on the machine inward side of the third coupling portion 46C. In that case, the detection element 59B of the second detection device 58B is engaged with the slit groove 57C of the third shaft member 53C. In addition, the second detection device 58B may be provided on both of the machine outward side of the third coupling portion 46C and the machine inward side of the fourth coupling portion 46D.

In the structure of the supporting portion 22 mentioned above, the coupling body 43 is not necessarily required for the connection between the first yoke 42 and the second yoke 44. For example, the second yoke 44 may be coupled to the first yoke 42 by a cross pin so as to be rotatable about the first axis Y1 and to be rotatable about the second axis Y2 other than the first axis Y1. The cross pin is a member having four pins arranged at right angles to each other in one plane and connected to each other.

Although it is preferable that the first axis Y1 is substantially parallel to the front-rear direction K1, the first yoke 42 may be fixed to the base 21 so that the first axis Y1 is substantially parallel to the machine width direction K2.

As shown in FIG. 1 and FIG. 2, the plurality of push rods 23A to 23D are arranged such that one end sides (upper end sides) 61A to 61D of the plurality of push rods 23A to 23D contact to the swing body 24 around the rotation fulcrum Y3. In other words, one end sides 61A to 61D of the plurality of push rods 23A to 23D are in contact with the grip 25 via the swing body 24 (another member). In addition, the one end sides 61A to 61D of the plurality of push rods 23A to 23D may be in contact with the grip 25 in direct. That is, the plurality of push rods 23A to 23D are arranged at positions where the one end sides 61A to 61D are in contact with the grip 25 directly or via another member. In addition, the plurality of push rods 23A to 23D are arranged symmetrically with respect to an imaginary straight line Y4 extending in the vertical direction and passing through the rotation fulcrum Y3.

The plurality of push rods 23A to 23D include a first push rod 23A, a second push rod 23B, a third push rod 23C, and a fourth push rod 23D. The main portions of the first push rod 23A to the fourth push rod 23D are formed in a cylindrical shape. One end sides 61A to 61D of the first push rod 23A to the fourth push rod 23D have a curved shape (a spherical shape) convex toward the swing body 24 side (convex upward).

As shown in FIG. 3, the first push rod 23A is arranged on one side in the extending direction of the first axis Y1 with respect to the rotation fulcrum Y3. In particular, the first push rod 23A is arranged in front of the rotation fulcrum Y3 (the supporting portion 22). The second push rod 23B is arranged on the other side in the extending direction of the first axis Y1 with respect to the rotation fulcrum Y3. In particular, the second push rod 23B is arranged behind the rotation fulcrum Y3 (the supporting portion 22). As shown in FIG. 4, the third push rod 23C is arranged on one side in the extending direction of the second axis Y2 with respect to the rotation fulcrum Y3. In particular, the third push rod 23C is arranged to the left (the machine inward) of the rotation fulcrum Y3 (the supporting portion 22). The fourth push rod 23D is arranged on the other side in the extending direction of the second axis Y2 with respect to the rotation fulcrum Y3. In particular, the fourth push rod 23D is arranged to the right (the machine outward) of the rotation fulcrum Y3 (the supporting portion 22).

As shown in FIG. 3 and FIG. 4, the push rods (the first push rod 23A to the fourth push rod 23D) are slidably inserted to the sleeves (the first sleeve 36A to the fourth sleeve 36D). To explain individually, the first push rod 23A is inserted to the first sleeve 36A so as to be slidable in a direction of the axial center from below. Thus, the first push rod 23A extends in the inclined direction same as the inclined direction of the axis of the first supporting hole 34A. The second push rod 23B is inserted to the second sleeve 36B so as to be slidable in a direction of the axial center from below. Thus, the second push rod 23B extends in the inclined direction same as the inclined direction of the axis of the second supporting hole 34B. The third push rod 23C is inserted to the third sleeve 36C so as to be slidable in a direction of the axial center from below. Thus, the third push rod 23C extends in the inclined direction same as the inclined direction of the axis of the third supporting hole 34C. The fourth push rod 23D is inserted to the fourth sleeve 36D so as to be slidable in a direction of the axial center from below. Thus, the fourth push rod 23D extends in the inclined direction same as the inclined direction of the axis of the fourth supporting hole 34D.

As shown in FIG. 3 and FIG. 4, the other end sides (the lower end sides) 76A to 76D of the push rods (the first push rod 23A to the fourth push rod 23D) are provided with contacting portions 62A to 62D respectively contact to the retaining portions (the first retaining portion 37A to the fourth retaining portion 37D) so as to prevent the push rods from slipping off from the sleeves (the first sleeve 36A to the fourth sleeve 36D) to the one end sides. To explain individually, the contacting portion (a first contacting portion) 62A having an outward flange-shape is provided on the other end side 76A of the first push rod 23A. The first contacting portion 62A contacts to the lower surface of the first retaining portion 37A. The contacting portion (a second contacting portion) 62B having an outward flange-shape is provided on the other end side 76B of the second push rod 23B. The second contacting portion 62B contacts to the lower surface of the second retaining portion 37B. The contacting portion (a third contacting portion) 62C having an outward flange-shape is provided on the other end side 76C of the third push rod 23C. The third contacting portion 62C contacts to the lower surface of the third retaining portion 37C. The contacting portion (a fourth contacting portion) 62D having an outward flange-shape is provided on the other end side 76D of the fourth push rod 23D. The fourth contacting portion 62D contacts to the lower surface of the fourth retaining portion 37D.

As shown in FIG. 1 and FIG. 2, pushing members 63A to 63D are provided below the push rods 23A to 23D, the pushing members 63A to 63D being configured to respectively push the push rods 23A to 23D to the one end sides 61A to 61D along the extending directions of the push rods 23A to 23D. The pushing members 63A to 63D are members to hold the grip 25 in the neutral position under a state where the grip 25 is not operated and to return the grip 25 from the operated position to the neutral position. Each of the pushing members 63A to 63D is formed of a compression coil spring. The pushing members 63A to 63D include a first pushing member 63A, a second pushing member 63B, a third pushing member 63C, and a fourth pushing member 63D. As shown in FIG. 3, the first pushing member 63A is compressed and interposed between the first contacting portion 62A and the first spring accepting portion 41A. The second pushing member 63B is compressed and interposed between the second contacting portion 62B and the second spring accepting portion 41B. As shown in FIG. 4, the third pushing member 63C is compressed and interposed between the third contacting portion 62C and the third spring accepting portion 41C. The fourth pushing member 63D is compressed and interposed between the fourth contacting portion 62D and the fourth spring accepting portion 41D.

Figure 8:
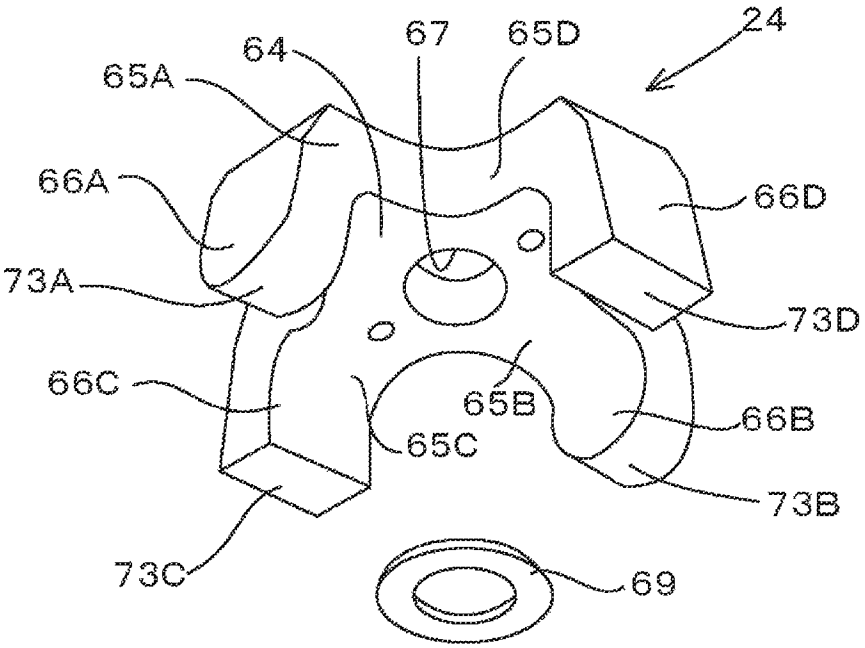
FIG. 8 is a perspective view illustrating a swing body and a shim according to the embodiment.

As shown in FIG. 3, FIG. 4, and FIG. 8, the swing body 24 has an attachment wall portion 64, first arm portion 65A to a fourth arm portion 65D, and first extending portion 66A to fourth extending portion 66D. The attachment wall portion 64 has an attachment hole 67. The attachment hole 67 is formed of an annular edge portion (a circumferential surface) that is formed penetrating the attachment wall portion 64 in the vertical direction. The attachment wall portion 64 is positioned above the second connecting portion 47B, and the attachment shaft 54 is inserted to the attachment hole 67 from below. The threaded portion 54*a* of the attachment shaft 54 protrudes upward from the attachment wall portion 64, and fastening tools 68A and 68B are screwed to the protruding portion (see FIG. 1 and FIG. 2). By the fastening tools 68A and 68B, the swing body 24 is fixed to the second yoke 44. In the present embodiment, nuts are used as the fastening tools 68A and 68B.

As shown in FIG. 3 and FIG. 4, a shim 69 is interposed between the second yoke 44 and the swing body 24. By selectively interposing the shims 69 having different thicknesses between the second yoke 44 and the swing body 24, the position of the swing body 24 can be adjusted along the extending direction of the attachment shaft 54. That is, the shim 69 is a member configured to adjust the position of the swing body 24 along the extending direction of the attachment shaft 54. The shim 69 is formed in a ringed disk shape (see FIG. 8), and is externally fitted to the attachment shaft 54 between the swing body 24 and the first yoke 42.

As shown in FIG. 3, the first arm portion 65A protrudes forward from the attachment wall portion 64. The second arm portion 65B protrudes rearward from the attachment wall portion 64. As shown in FIG. 4, the third arm portion 65C protrudes leftward (toward the machine inward direction) from the attachment wall portion 64. The fourth arm portion 65D protrudes rightward (toward the machine outward direction) from the attachment wall portion 64.

As shown in FIG. 4, a first restriction pin 71A is provided extending between the base portion (the swing body 24) of the third arm portion 65C and the third coupling portion 46C (the second yoke 44) of the third arm portion 65C. In addition, a second restriction pin 71B is provided extending between the base portion (the swing body 24) of the fourth arm portion 65D and the fourth coupling portion 46D (the second yoke 44) of the fourth arm portion 65D. The first restriction pin 71A and the second restriction pin 71B mentioned above restrict the second yoke 44 and the swing body 24 from relatively rotating around the attachment shaft 54. That is, the first restricting pin 71A and the second restricting pin 71B constitute a rotation preventing portion 72 configured to restrict the second yoke 44 and the swing body 24 from relatively rotating around the attachment shaft 54. Meanwhile, the rotation preventing portion may have a rotation preventing structure constituted by bringing a flat surface formed on a part of the inner surface of the attachment hole 67 into contact with a flat surface formed on a part of the outer surface of the attachment shaft 54.

As shown in FIG. 3, the first extending portion 66A extends downward from the protruding end portion (a tip end) of the first arm portion 65A. The lower surface of the first extending portion 66A is the first contacting surface 73A that is contacted to a side of the one end 61A of the first push rod 23A. The second extending portion 66B extends downward from the protruding end portion (the tip end) of the second arm portion 65B. The lower surface of the second extending portion 66B is a second contacting surface 73B that is contacted to a side of the one end 61B of the second push rod 23B.

As shown in FIG. 4, the third extending portion 66C extends downward from the protruding end portion (a tip end) of the third arm portion 65C. The lower surface of the third extending portion 66C is the third contacting surface 73C that is contacted to a side of the one end 61C of the third push rod 23C. The fourth extending portion 66D extends downward from the protruding end portion (the tip end) of the fourth arm portion 65D. The lower surface of the fourth extending portion 66D is a fourth contacting surface 73D that is contacted to a side of the one end 61D of the fourth push rod 23D.

Figure 10:
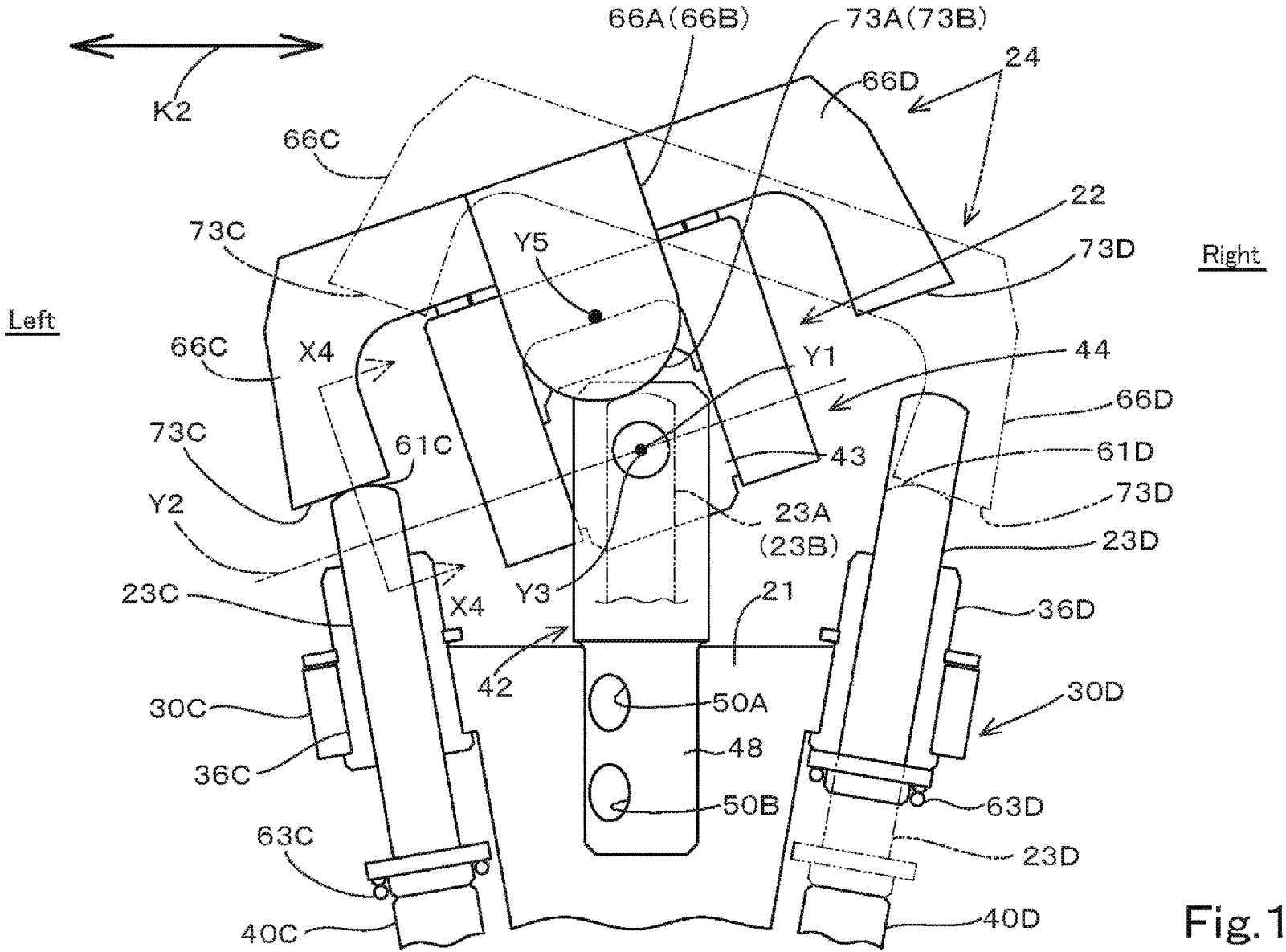
FIG. 10 is a cross-sectional view illustrating a rear surface of the operation device under an operating state according to the embodiment.

As shown in FIG. 8 and FIG. 10, the first contacting surface 73A and the second contacting surface 73B are formed in a curved surface shape (a circular arc shape). The first contacting surface 73A has a curved surface shape that is convex toward the first push rod 23A, and the second contacting surface 73B has a curved surface shape that is convex toward the second push rod 23B. In addition, under a state where the grip 25 is positioned at the neutral position, each of the first contacting surface 73A and the second contacting surface 73B has a curved surface shape (a circular arc shape) curving about a line Y5 parallel to the second axis Y2 (see FIG. 10) as shown in FIG. 3.

As shown in FIG. 8, the third contacting surface 73C and the fourth contacting surface 73D are formed to have flat surfaces. As shown in FIG. 4, under a state in which the grip 25 is positioned at the neutral position, the third contacting surface 73C and the fourth contacting surface 73D have a planar shape parallel to the first axis Y1 and the second axis Y2.

The thickness of the shim 69 is changed in accordance with the contact state between the first to fourth contact surfaces 73A to 73D and the first to fourth push rods 23A to 23D. That is, by changing the thickness of the shim 69, the contact state between the first to fourth contact surfaces 73A to 73D and the first to fourth push rods 23A to 23D can be optimized.

The grip 25 is a member to be gripped by an operator (a user) who operates the operation device 19R (19L). As shown in FIG. 1 and FIG. 2, the grip 25 includes a first grip portion 74 which is the upper portion of the grip and includes a second grip portion 75 which is a portion below the first grip portion 74 (a lower portion of the grip 25). For example, the operator brings the palm of the hand into contact with the first grip portion 74 and grips the grip 25 by bringing the little finger (or little finger and a ring finger) into contact with the second grip portion 75. The grip 25 has a hollow shape with a lower surface (a bottom surface 25A) opened. The inner surface of the lower portion of the grip 25 has an opening area gradually increasing toward a side of the bottom surface 25A (the lower surface). In addition, the inner surface of the grip 25 has a distance from the imaginary straight line Y4, the distance gradually increasing from the positions corresponding to the one end sides 61A to 61D of the push rods (the first to fourth push rods 23A to 23D) toward the bottom surface 25A side. In addition, each of the push rods (the first to fourth push rods 23A to 23D) is inserted into the grip 25 from the bottom surface 25A of the grip 25 such that the one end sides 61A to 61D are arranged on a deep inner side 25B of the grip 25, and is arranged so as to have a distance from the imaginary straight line Y4, the distance gradually decreasing the one end sides 61A to 61D toward the other end sides 76A to 76D. Meanwhile, note that the deep inner side 25B of the grip 25 is on the side opposite to the opening of the bottom surface (the lower surface) 25A, and in the present embodiment, the upper portion in the grip 25 is the deep inner side 25B.

Figure 9A:
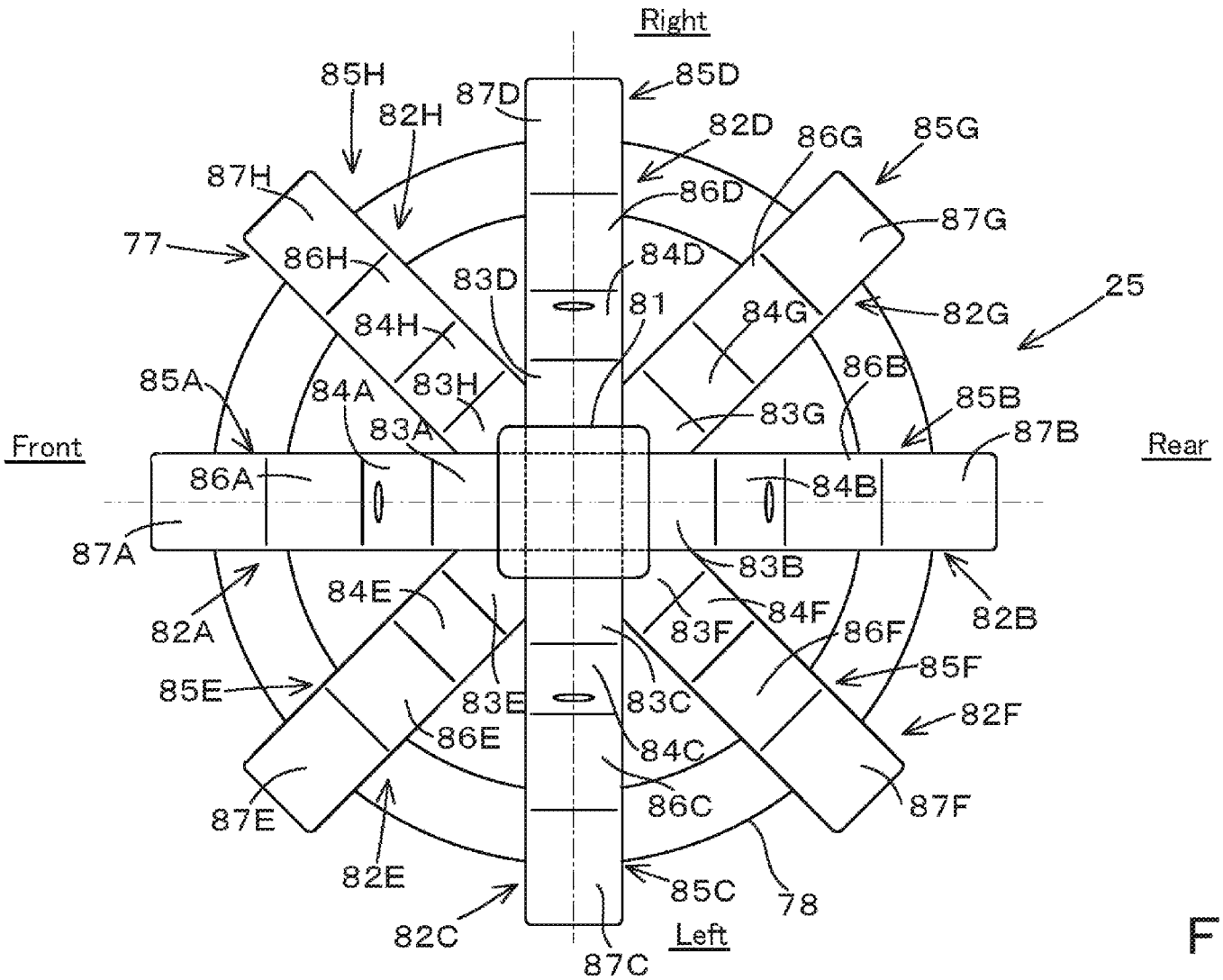
FIG. 9A is a plan view illustrating a grip according to the embodiment.
Figure 9B:
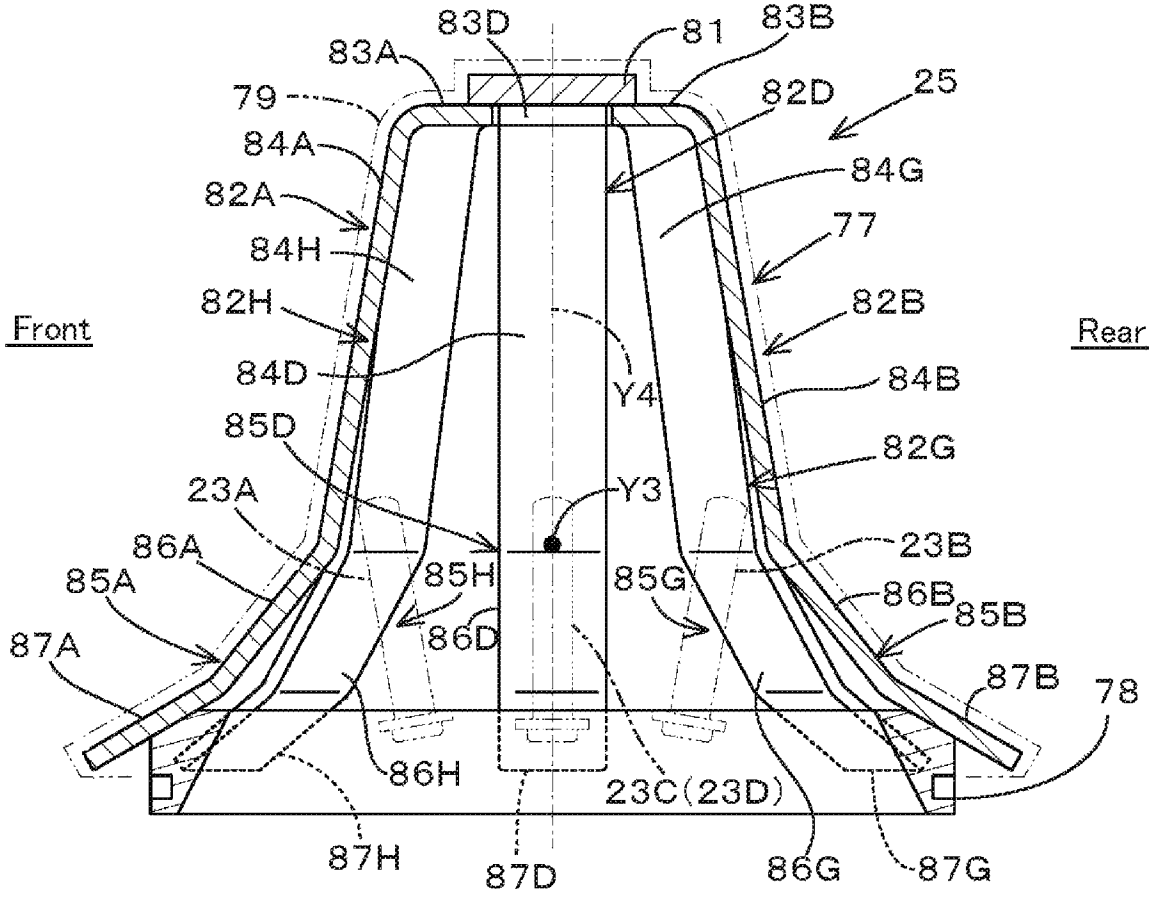
FIG. 9B is a cross-sectional view illustrating a side surface of the grip according to the embodiment.
Figure 13:
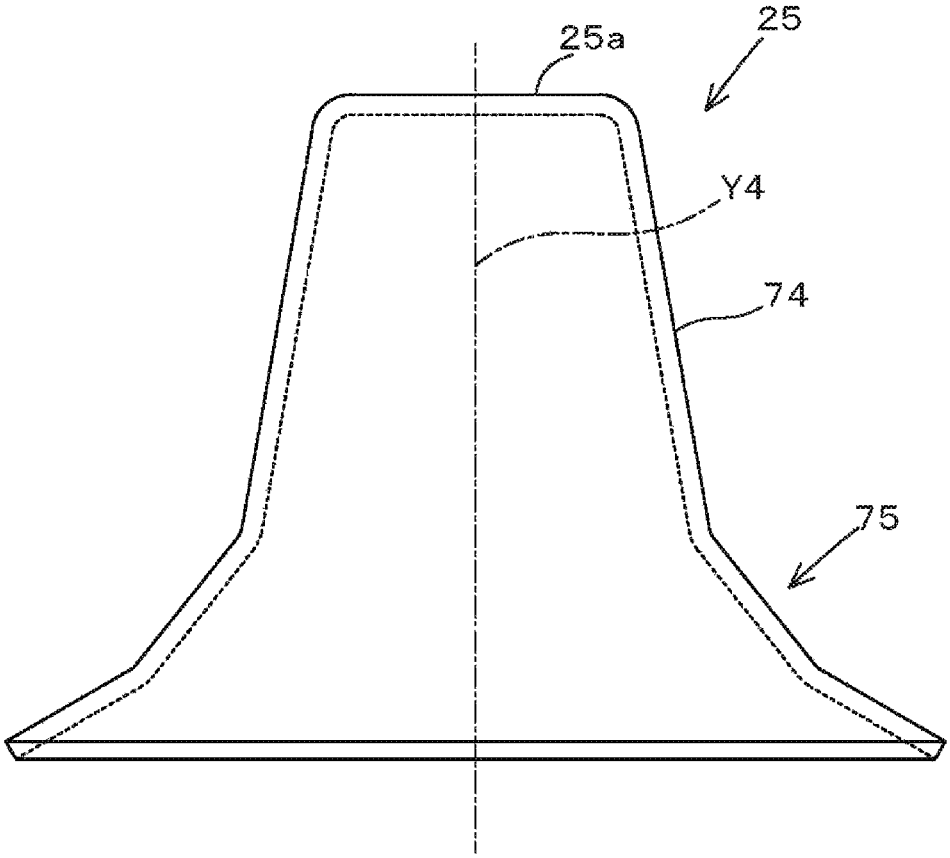
FIG. 13 is a view illustrating a side surface of the grip according to a modified example.

As shown in FIG. 9A and FIG. 9B, the grip 25 has a grip main body 77 and a lower frame 78. The grip main body 77 is a member constituting the skeleton of the grip 25. As indicated by the imaginary line in FIG. 9B, the grip main body 77 is preferably covered with a cover member 79 made of resin or the like from the upper end to the lower end and around the entire circumference. In addition, as shown in FIG. 13, the grip main body 77 may be integrally formed of resin or the like so as to form a closed shape except the lower end opening. That is, in the grip 25 shown in FIG. 13, the first grip portion 74 and the second gripping portion 75 are formed of circumferential walls continuous over the entire circumference in the circumferential direction around the imaginary straight line Y4, and the upper wall 25*a* is formed of a circular wall portion covering the upper end of the first grip portion 74. As described above, the grip 25 has a hollow shape with the bottom surface (the lower surface) 25A opened.

As shown in FIG. 9A and FIG. 9B, the grip main body 77 includes a top plate 81 and first to eighth plate members 82A to 82H. The top plate 81 is formed in a rectangular shape, and is arranged so that its plate surfaces face upward and downward. The first plate member 82A to the eighth plate member 82H are formed of a band plate member. The first plate member 82A is positioned on the front portion of the grip 25. The second plate member 82B is positioned on the rear portion of the grip 25. The third plate member 82C is positioned on the left portion of the grip 25. The fourth plate member 82D is positioned on the right portion of the grip 25. The fifth plate member 82E is positioned between the first plate member 82A and the third plate member 82C. The sixth plate member 82F is positioned between the second plate member 82B and the third plate member 82C. The seventh plate member 82G is positioned between the second plate member 82B and the fourth plate member 82D. The eighth plate member 82H is positioned between the first plate member 82A and the fourth plate member 82D.

The first plate member 82A has a first portion 83A, a second portion 84A, and a third portion 85A. The second plate member 82B also has a first portion 83B, a second portion 84B, and a third portion 85B. The third plate member 82C also has a first portion 83C, a second portion 84C, and a third portion 85C. The fourth plate member 82D also has a first portion 83D, a second portion 84D, and a third portion 85D. The fifth plate member 82E also has a first portion 83E, a second portion 84E, and a third portion 85E. The sixth plate member 82F also has a first portion 83F, a second portion 84F, and a third portion 85F. The seventh plate member 82G also has a first portion 83G a second portion 84G, and a third portion 85G. The eighth plate member 82H also has a first portion 83H, a second portion 84H, and a third portion 85H.

Each of the first portions 83A to 83H protrudes in the radial direction from the top plate 81, and forms the upper wall of the grip 25 together with the top plate 81. Each of the second portions 84A to 84H is a portion that forms the first grip portion 74. Each of the second portions 84A to 84H is inclined in a direction expanding outward from the inside portion of the grip 25 as it goes downward. Each of the third portions 85A to 85H is a portion that forms the second grip portion 75. The upper portions 86A to 86H of the third portions 85A to 85H are inclined in a direction expanding outward from the inside portion of the grip 25 as it goes downward, and are inclined at an angle larger than an angle of the second portion 84. The lower portions 87A to 87H of the third portions 87A to 87H are inclined in a direction expanding outward from the inside portion of the grip 25 as it goes downward, and are inclined at an angle larger than the angles of the upper portions 86A to 86H.

As shown in FIG. 1 and FIG. 2, the grip main body 77 (the grip 25) is provided to wrap (to cover) covers the supporting portion 22, the swing body 24, the first to fourth push rods 23A to 23D, and the upper portion of the base 21.

As shown in FIG. 1, the first extending portion 66A is fixed to the lower portion of the second portion 84A of the first plate member 82A by a screw 88A. In addition, the second extending portion 66B is fixed to the lower portion of the second portion 84B of the second plate member 82B by the screw 88B. As shown in FIG. 2, a third extending portion 66C is fixed to the lower portion of the second portion 84C of the third plate member 82C by a screw 88C. A fourth extending portion 66D is fixed to the lower portion of the second portion 84D of the fourth plate member 82D by a screw 88D. Thus, the grip 25 is attached to the second yoke 44 via the swing body 24. In other words, the swing body 24 connects the second yoke 44 and the grip 25 to each other. Meanwhile, it should be noted that the grip 25 may be directly attached to the second yoke 44. That is, the grip 25 is attached to the second yoke 44 directly or via another member.

As shown in FIG. 9A, the lower frame 78 is formed in a ring shape, and is fixed over to the lower portions 87A to 87H of the third portions 85A to 85H. As shown in FIG. 1 and FIG. 2, an upper portion of a boot 89 formed of rubber is attached to the outer surface of the lower frame 78. The lower portion of the boot 89 is attached to the outer circumferential surface of the base portion 26 of the base 21.

As shown in FIG. 1 and FIG. 2, in the present embodiment, the rotation fulcrum Y3 of the grip 25, which is the intersection of the first axis Y1 with the second axis Y2, is positioned inside the grip 25. In addition, the rotation fulcrum Y3 is positioned in a region surrounded by the first grip portion 74 that is a portion gripped by the operator in the grip 25. In addition, the supporting portion 22 is housed inside the grip 25. The supporting portion 22 and the fixing portion 21A, which is a portion to which the supporting portion 22 of the base 21 is attached, are inserted into the grip 25.

Meanwhile, the present embodiment has explained a configuration in which the grip 25 includes the top plate 81 and the first to eighth plates 82A to 82H, but a configuration of the grip 2 is not limited to the configuration. For example, the grip 25 may be constituted of a cover member 79 made of resin or the like, omitting the top plate 81 and the first to eighth plates 82A to 82H.

FIG. 1 and FIG. 2 show a state in which the grip 25 is positioned in the neutral position. As shown in FIG. 1 and FIG. 2, when the grip 25 is not rotated, the position of the grip 25 is regulated to the neutral position by the first to fourth push rods 23A to 23D (the push rods). That is, the first push rod 23A is brought into contact with the first contacting surface 73A by the pushing force of the first pushing member 63A, the second push rod 23B is brought into contact with the second contacting surface 73B by the pushing force of the second pushing member 63B, the third push rod 23C is brought into contact with the third contacting surface 73C by the pushing force of the third pushing member 63C, the fourth push rod 23D is brought into contact with the fourth contacting surface 73D by the pushing force of the fourth pushing member 63D, and thereby the grip 25 is held at the neutral position by the pushing forces of the first to fourth pushing members 63A to 63D.

When the grip 25 is rotated from the neutral position around the first axis Y11 in the machine width direction K2 (a first operation direction), the second yoke 44 and the coupling body 43 are rotated about the first axis Y1 as shown in FIG. 10. Then, the third push rod 23C or the fourth push rod 23D (of the push rods) is pushed by the swing body 24 (or directly by the grip 25). That is, when the grip 25 is swung to the left, the third push rod 23C (of the push rods) overcomes the pushing force of the third pushing member 63C (the pushing member), and moves downward in the extending direction of the third push rod 23C (of the push rods). In addition, when the grip 25 is swung to the right, the fourth push rod 23D (of the push rods) overcomes the pushing force of the fourth pushing member 63D (the pushing member), and moves downward in the extending direction of the fourth push rod 23D (of the push rod). In this manner, the first operation target is operated. Explaining the operation of the first operation target with the above-mentioned example, in the operation device 19L, when the swing body 24 (the grip 25) is swung to the left (to the machine inward direction), the machine body 2 turns to the left, and when the moving body 24 (the grip 25) is swung to the right (to the machine outward direction), the machine body 2 turns to the right. In addition, in the operation device 19R, when the swing body 24 (the grip 25) is swung to the left (to the machine inward direction), the bucket 17 performs the crowding operation, and when the moving body 24 (the grip 25) is swung to the right (to the machine outward direction), the bucket 17 performs the dumping operation.

The extent of rotation (an operation extent) about the first axis Y1 of the grip 25 and the direction of operation both are detected by the first detection device 58A. On the basis of the detected value of the first detection device 58A, the first operation target is operated at a speed proportional to the rotation extent of the grip 25 around the first axis Y1. In addition, it can be said that the first detection device 58A is a detector configured to detect the movement amount of the third push rod 23C or the fourth push rod 23D (of the push rods).

Meanwhile, in order to detect the movement amount of the third push rod 23C, the movement of the third push rod 23C may be directly detected, and in order to detect the movement amount of the fourth push rod 23D, the movement of the fourth push rod 23D may be directly detected.

Figure 11:
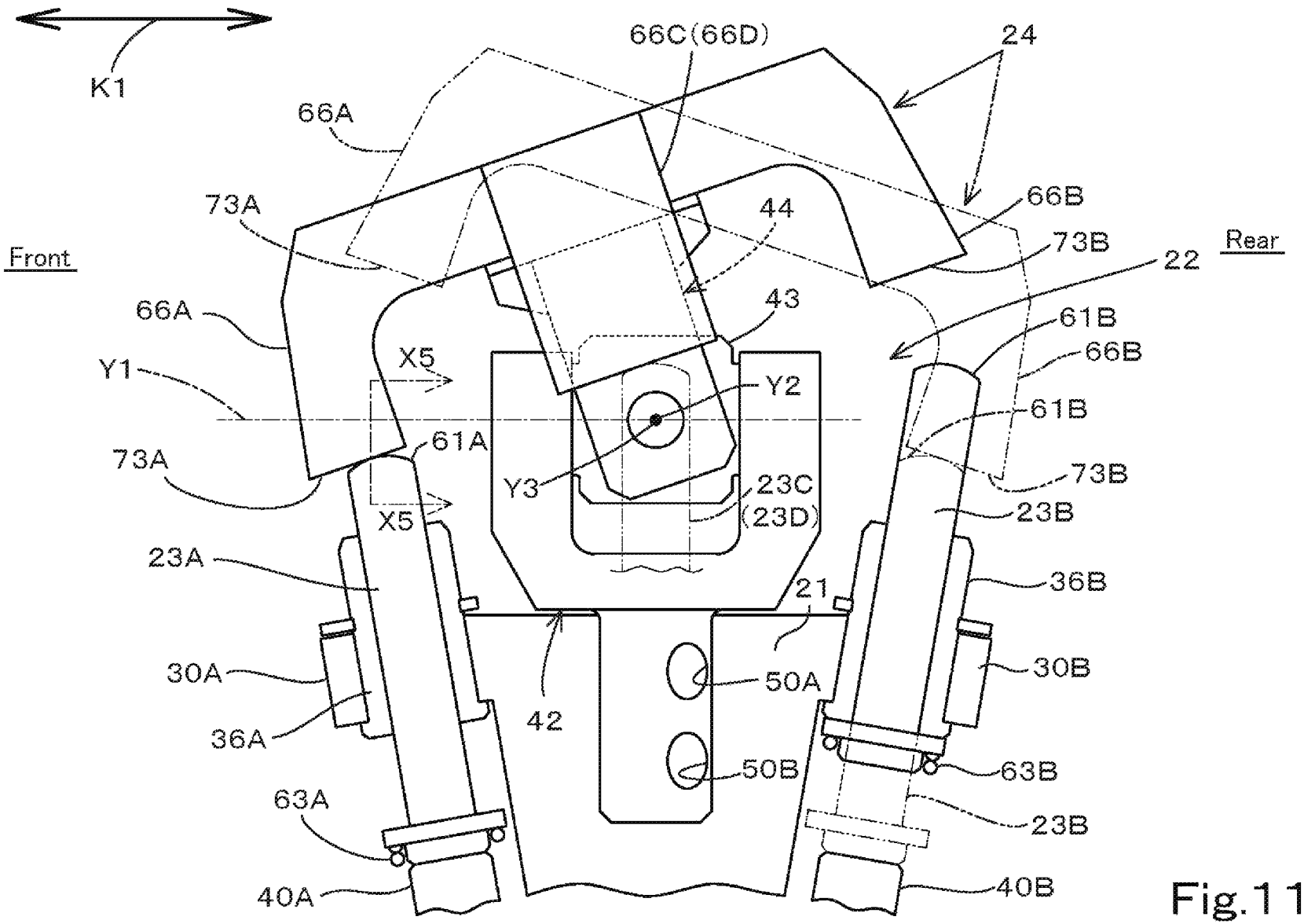
FIG. 11 is a cross-sectional view illustrating a side surface of the operation device under an operating state according to the embodiment.

In addition, when the grip 25 is rotated from the neutral position around the second axis Y2 in the front-rear direction K1 (the second operation direction), the second yoke 44 is rotated around the second axis Y2 as shown in FIG. 11. Then, the first push rod 23A or the second push rod 23B (the push rod) is pushed by the swing body 24 (or directly by the grip 25). That is, when the grip 25 is swung forward, the first push rod 23A (the push rod) overcomes the pushing force of the first pushing member 63A (the pushing member), and thereby the first push rod 23A moves downward in the stretching direction of the first push rod 23A. In addition, when the grip 25 is swung backward, the second push rod 23B (the push rod) overcomes the pushing force of the second pushing member 63B (the pushing member), and thereby the second push rod 23B moves downward in the stretching direction of the second push rod 23B. In this manner, the second operation target is operated. To explain the operation of the second operation target with the example mentioned above, the arm 16 performs the dumping operation when the operation device 19L is swung to the front side, and the arm 16 performs the crowding operation when the operation device 19L is swung to the rear side. In addition, the boom is moved downward when the operation device 19R is swung to the front side, and the boom is moved upward when the operation device 19R is swung to the rear side.

The amount of rotation (an operation amount) of the grip 25 about the second axis Y2 and the direction of the operation are detected by the second detection device 58B. On the basis of the detection value of the second detection device 58B, the second operation target is operated at a speed proportional to the amount of rotation of the grip 25 around the second axis Y2. In addition, it can be said that the second detection device 58B is a detector configured to detect the movement amount of the first push rod 23A or the second push rod 23B (of the push rod).

Meanwhile, in order to detect the movement amount of the first push rod 23A, the movement of the first push rod 23A in the extending direction may be directly detected, and in order to detect the movement amount of the second push rod 23B, the movement of the second push rod 23B in the extending direction may be directly detected.

On the other hand, when the grip 25 is operated from the neutral position in an arbitrary oblique direction between the first operation direction (the front-rear direction K1) and the second operation direction (the machine width direction K2), the first operation target and the second operation target are simultaneously operated (the first operation target and the second operation target are operated in combine).

As described above, the position of the grip 25 is regulated to the neutral position by each of the push rods 23A to 23D when the grip 25 is not rotated in the operation, and when the grip 25 is rotated in the operation, one of or the plurality of push rods 23A to 23D is pushed by the grip 25 (directly by the grip 25 or via another member) via the swing body 24 in accordance with the rotational direction, and thereby the push rods 23A to 23D overcome the pushing force of the pushing members 63A to 63D to move in the stretching direction of the push rods 23A to 23D.

Figure 12A:
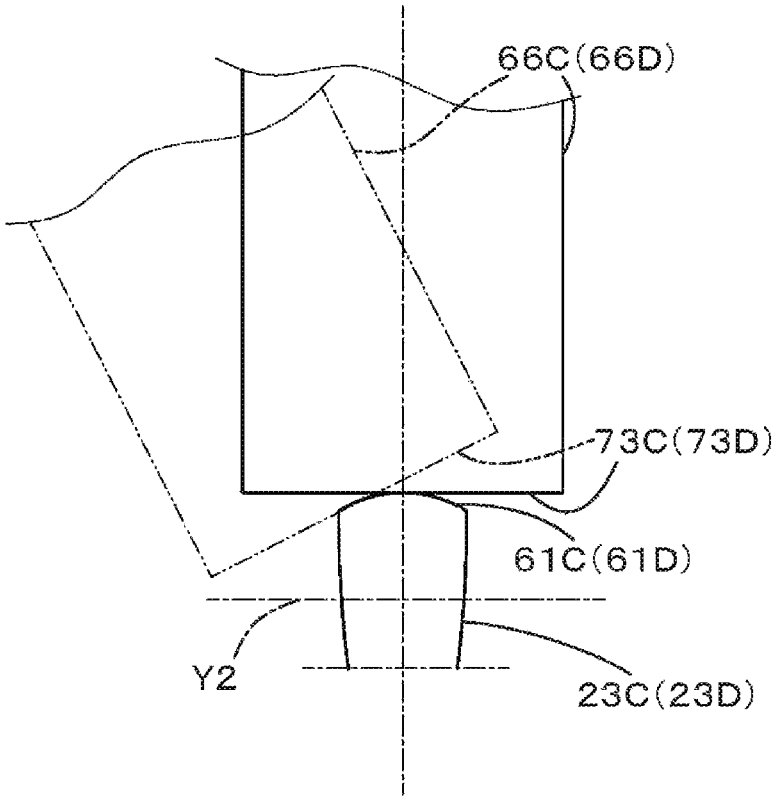
FIG. 12A is a cross-sectional view of FIG. 10 in X4-X4 arrowed lines.

Here, explained will be the reason why the first contacting surface 73A and the second contacting surface 73B are both formed to have the curved surface. The solid line in FIG. 12A shows the cross section illustrating FIG. 10 taken along the line X4-X4. The solid line in FIG. 10 shows a state in which the grip 25 is rotated in the full stroke to the left around the first axis Y1. The full stroke means to operate until the push rods 23A to 23D are in contact with the stoppers 40A to 40D.

When the grip 25 is rotated in the full stroke forward (or backward) around the second axis Y2 from the state in which the grip 25 is rotated in the full stroke to the left around the first axis Y1, the third contacting surface 73C moves on the end surface of the one end side 61C of the third push rod 23C along the end surface as shown by the virtual line of FIG. 12A. Thus, the position of the third push rod 23C is not depended on the rotation around the second axis Y2 of the grip 25, and thus the configuration does not cause problems. In addition, same applies to the case where the grip 25 is rotated forward (or backward) in the full stroke around the second axis Y2 from the state in which the grip 25 is rotated in the full stroke to the right around the first axis Y1.

Figure 12B:
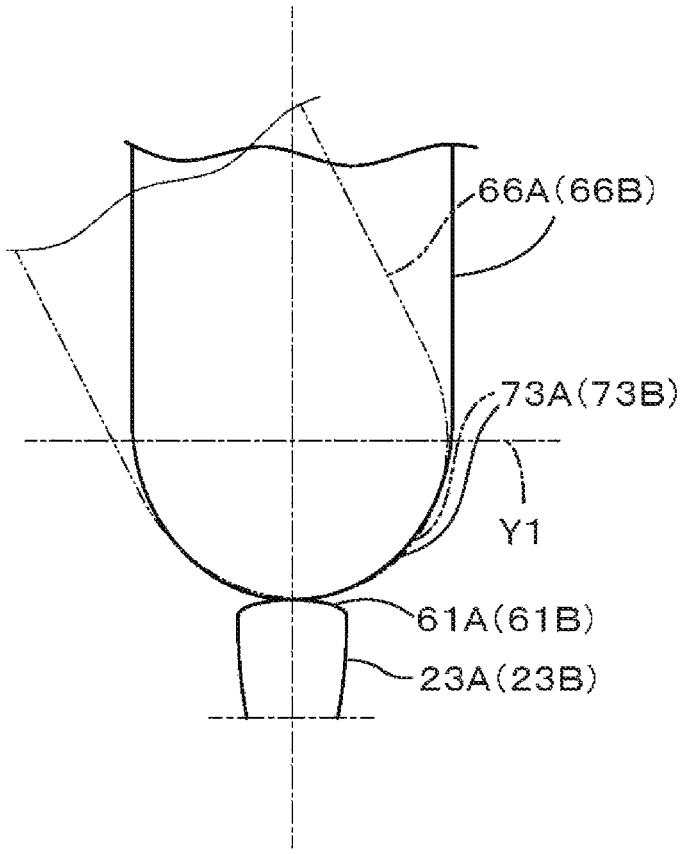
FIG. 12B is a cross-sectional view of FIG. 11 in X5-X5 arrowed lines.

The solid line in FIG. 12B shows a cross section of FIG. 11 taken along the line X5-X5. The solid line in FIG. 11 shows a state in which the grip 25 is rotated forward in the full stroke around the second axis Y2.

When the grip 25 is rotated in the full stroke rightward (or leftward) around the first axis Y1 from the state in which the grip 25 is rotated forward in the full stroke around the second axis Y2, as indicated by the virtual line in FIG. 12B, the first contacting surface 73A formed to have a curved surface slides on the end surface of the one end side 61A of the first push rod 23A. Thus, the position of the first push rod 23A does not depend on the rotation of the grip 25 around the first axis Y1, and thus the configuration does not cause problems. In addition, In addition, same applies to the case where the grip 25 is rotated rightward (or leftward) in the full stroke around the first axis Y1 from the state in which the grip 25 is rotated backward in the full stroke around the second axis Y2.

Figure 12C:
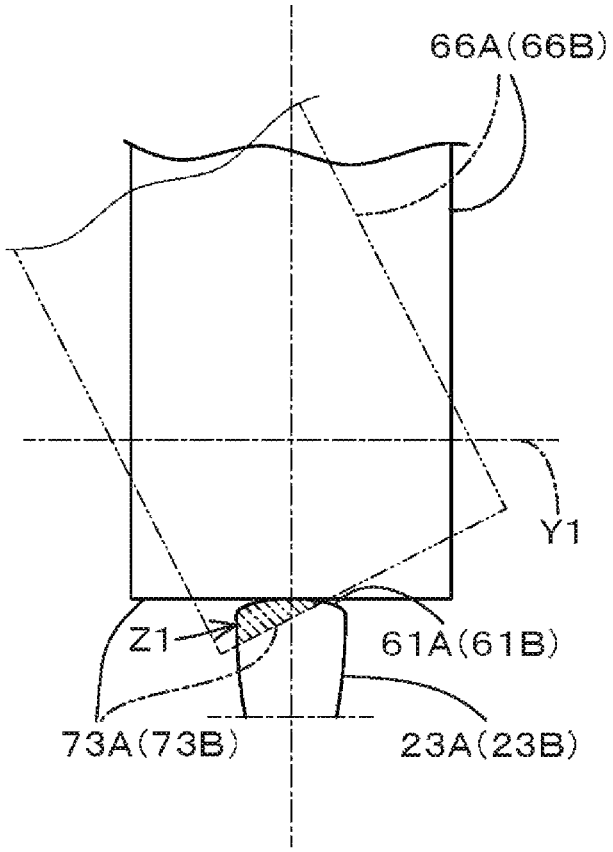
FIG. 12C is a cross-sectional view illustrating a first contacting surface and a second contacting surface each having flat surfaces according to the embodiment.

On the other hand, FIG. 12C shows a case where it is assumed that the first contacting surface 73A and the second contacting surface 73B are formed to be flat surfaces. That case will be explained with the reference numerals same as in the present embodiment. A solid line of FIG. 12C shows a state in which the grip 25 is rotated forward in the full stroke about the second axis Y2, that is, a cross section corresponding to a cross section of FIG. 11 taken along the line X5-X5.

When the grip 25 is rotated in the full stroke to the right (or to the left) around the first axis Y1 from that state, the first contacting surface 73A tries to move so as to push down the first push rod 23A as shown by a virtual line in FIG. 12C, when the first contacting surface 73A is a flat surface. However, since the first push rod 23A is in contact with the first stopper 40A and thus does not move (see FIG. 11), the first contacting surface 73A is inevitably returned by the hatched portion Z1 in FIG. 12C. That is, in comparison with a state in which the grip 25 is rotated to the right in the full stroke, the grip 25 is returned around the first axis Y1 by the hatched portion in FIG. 12C from the position of the full stroke in a state in which the grip 25 is rotated forward and rightward in the full stroke. The same applies to a case where the grip 25 is rotated in the full stroke to the right (or to the left) about the first axis Y1 from the state in which the grip 25 is rotated backward in the full stroke around the second axis Y2.

Thus, in the case where the first contacting surface 73A and the second contacting surface 73B are formed to have flat surfaces, detection of the operation amount will be deviated when the operation amount of the grip 25 is detected based on the rotation around the first axis Y1. Thus, the first contacting surface 73A and the second contacting surface 73B are formed to be curved surfaces. More specifically, the first contacting surface 73A and the second contacting surface 73B are curved with a curvature at which the amount of movement of the first push rod 23A (or the second push rod 23B) in the rotation of the grip 25 with the full stroke around the first axis Y1 is substantially constant irrespective of the rotational position of the grip 25 around the second axis Y2 in the present embodiment. The first contacting surface 73A and the second contacting surface 73B are formed to be the curved surface with the curvature, and thereby the operation amount about the first axis Y1 can be appropriately detected regardless of the rotational position of the grip 25 around the second axis Y2.

Figure 14:
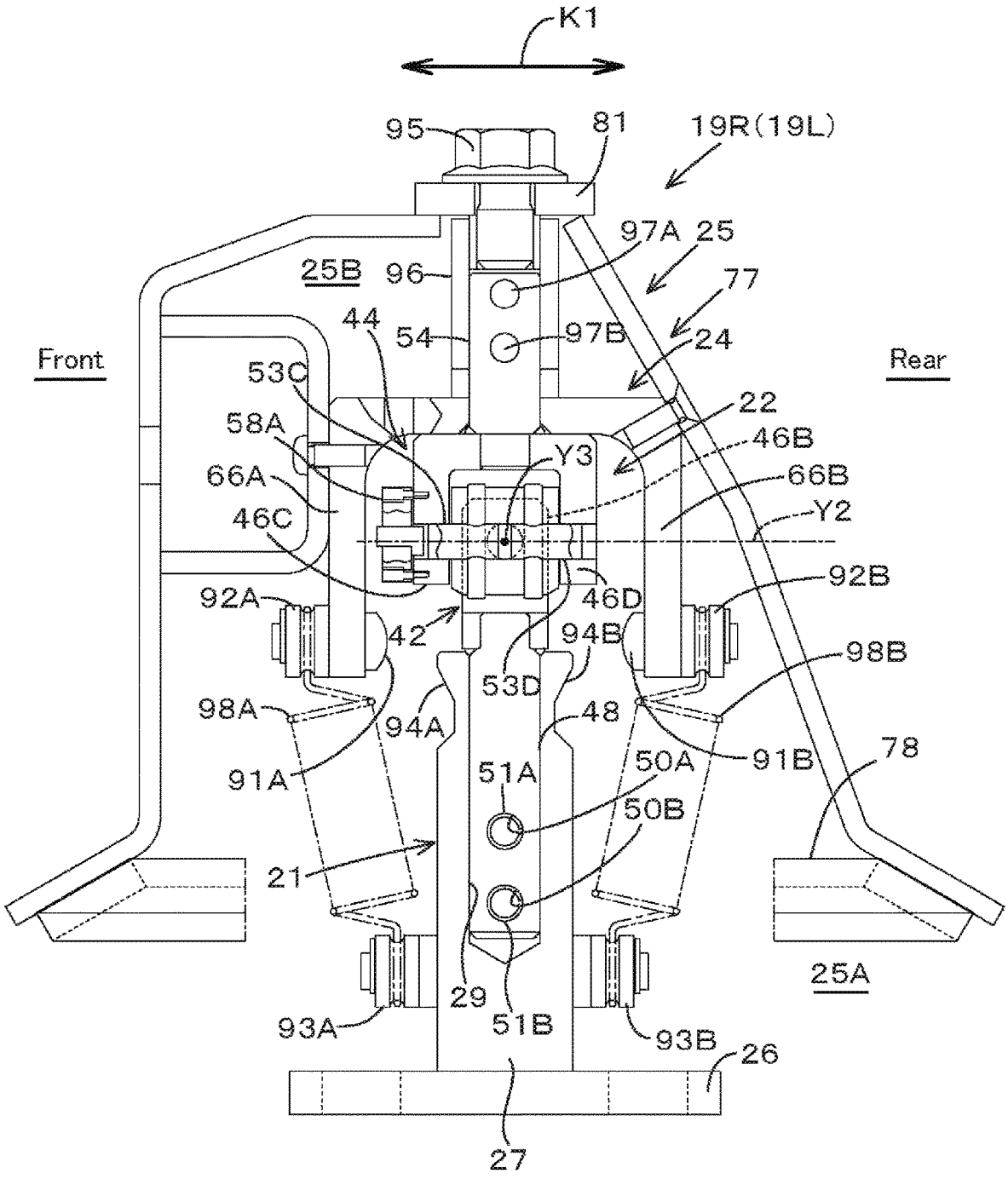
FIG. 14 is a cross-sectional view illustrating a left side surface of an operation device according to another embodiment.
Figure 15:
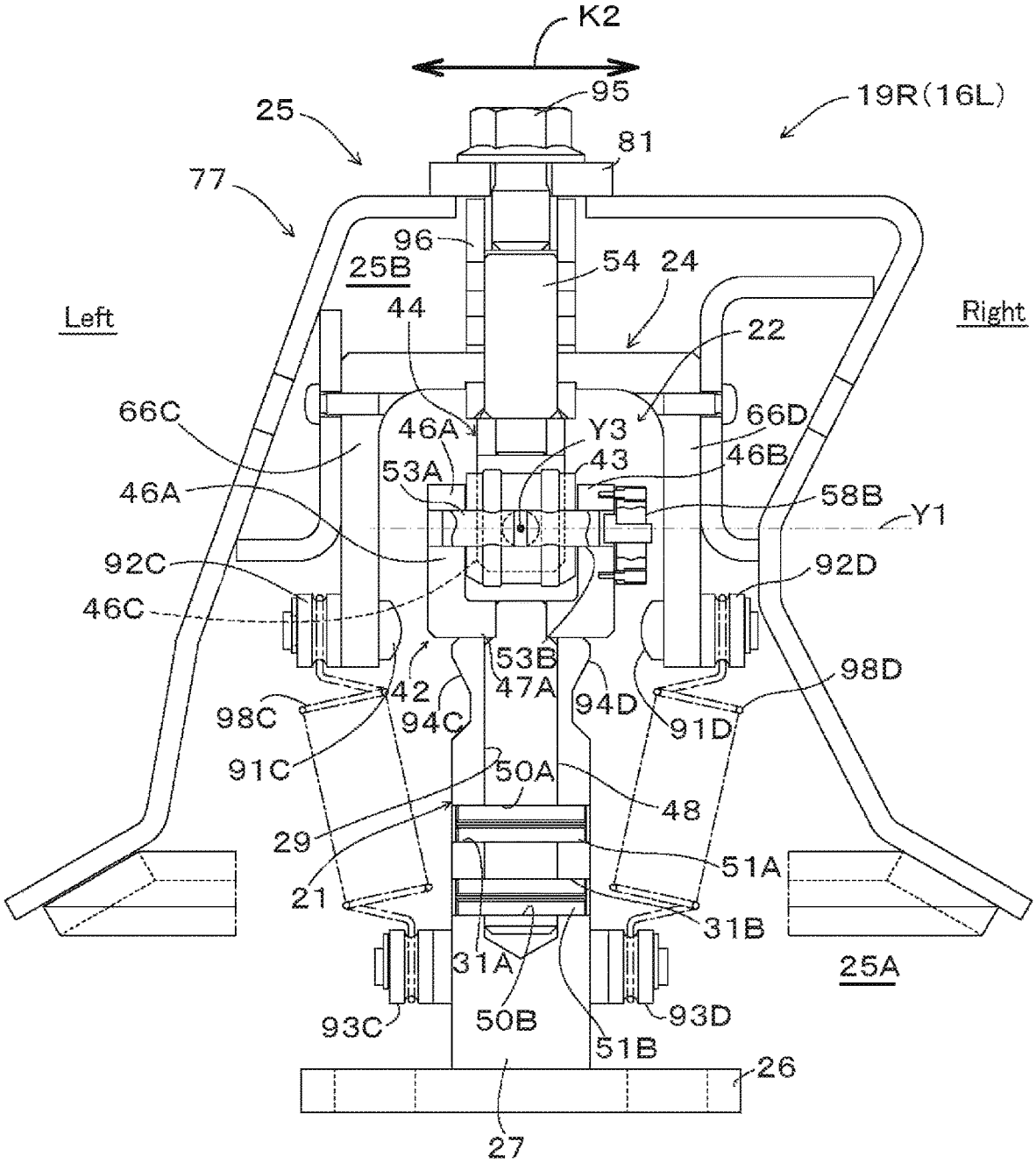
FIG. 15 is a cross-sectional view illustrating a rear surface of the operation device according to the other embodiment.

FIG. 14 and FIG. 15 show another embodiment. FIG. 14 is a cross sectional view of a left side surface of the operation device 19R (19L). FIG. 15 is a cross sectional view of a back surface of the operation device 19R (19L).

In the other embodiment, the grip main body 77 (the grip 25) is the same as that of the embodiment mentioned above in that the grip main body 77 has the hollow shape with the bottom surface 25A opened, but the grip main body 77 (the grip 25) is different from that of the embodiment mentioned above in that that the grip main body 77 has a shape different from that of the embodiment mentioned above. In the operation device 19L and the operation device 19R, the grip main body 77 is formed symmetrically with respect to the machine width direction K2. In the other embodiment, the first contact surface 73A to the fourth contact surface 73D, the push rods 23A to 23D, the sleeves 36A to 36D, and the stoppers 40A to 40D are not provided in the embodiment mentioned above.

The other embodiment is provided with a hitting member 91A to a hitting member 91D, an upper spring hooking portion 92A to an upper spring hooking portion 92D, and a lower spring hooking portion 93A to a lower spring hooking portion 93D. The contacting member includes a first hitting member 91A, a second hitting member 91B, a third hitting member 91C, and a fourth hitting member 91D. The upper spring hooking portion includes a first upper spring hooking portion 92A, a second upper spring hooking portion 92B, a third upper spring hooking portion 92C, and a fourth upper spring hooking portion 92D. The lower spring hooking portion includes a first lower spring hooking portion 93A, a second lower spring hooking portion 93B, a third lower spring hooking portion 93C, and a fourth lower spring hooking portion 93D.

The first hitting member 91A and the first upper spring hooking portion 92A are provided on the first extending portion 66A. The second hitting member 91B and the second upper spring contact portion 92B are provided on the second extending portion 66B. The third hitting member 91C and the third upper spring hooking portion 92C are provided on the third extending portion 66C. The fourth hitting member 91D and the fourth upper spring hooking portion 92D are provided on the fourth extending portion 66D.

The first lower spring hooking portion 93A is positioned below the first hitting member 91A, and is provided on the base 21 (the main body portion 27). The second lower spring hooking portion 93B is positioned below the second hitting member 91B, and is provided on the base 21 (the main body portion 27). The third lower spring hooking portion 93C is positioned below the third hitting member 91C, and is provided on the base 21 (the main body portion 27). The fourth lower spring hooking portion 93D is positioned below the fourth hitting member 91D, and is provided on the base 21 (the main body portion 27).

The base 21 is provided with a stopper surface 94A to a stopper surface 94D to which the hitting members (the first hitting member 91A to the fourth hitting member 91D) hit when the grip 25 is rotated in the full stroke. The stopper surface includes a first stopper surface 94A to which the first hitting member 91A hits, a second stopper surface 94B to which the second hitting member 91B hits, a third stopper surface 94C to which the third hitting member 91C hits, and a fourth stopper surface 94D to which the fourth hitting member 91D hits.

The pushing members 98A to 98D which hold the grip 25 in the neutral position and return the grip 25 from the operated position to the neutral position are formed of tension coil springs.

The pushing members 98A to 98D include a first pushing member 98A, a second pushing member 98B, a third pushing member 98C, and a fourth pushing member 98D. The first pushing member 98A is provided striding from the first upper spring hooking portion 92A to the first lower spring hooking portion 93A. The second pushing member 98B is provided striding from the second upper spring hooking portion 92B and the second lower spring hooking portion 93B. The third pushing member 98C is provided striding from the third upper spring hooking portion 92C to the third lower spring hooking portion 93C. The fourth pushing member 98D is provided striding from the fourth upper spring hooking portion 92D to the fourth lower spring hooking portion 93D.

The attachment portion 48 is formed separately from the first connecting portion 47A, and is fixed to the first connecting portion 47A. The point in which the attachment portion 48 is fitted into the fitting hole 29 of the base 21 and fixed by the fixing members (the pins) 50A and 50B is the same as that of the embodiment mentioned above.

A cylindrical body 96 attached to the top plate 81 by an attachment bolt 95 is provided on the lower side of the top plate 81 of the grip 25. The attachment shaft 54 is fixed to the cylindrical body 96 by the pin 97A and the pin 97B penetrating the cylindrical body 96 and the attachment shaft 54. The attachment shaft 54 is formed separately from the second connecting portion 47B, and is fixed to the second connecting portion 47B.

In the other embodiment, the first coupling portion 46A and the second coupling portion 46B are opposed to each other in the machine width direction K2. In addition, the third coupling portion 46C and the fourth coupling portion 46D are opposed to each other in the front-rear direction K1. Thus, the grip 25 is rotated forward or backward about the first axis Y1, and is rotated leftward or rightward about the second axis Y2.

As described above, the other embodiment has been described in terms of the points different from the above-mentioned embodiment shown in FIG. 1 to FIG. 13. The rest of the configuration is configured substantially in the same manner as the above-mentioned embodiment.

The present embodiment exemplifies the operation devices 19L and 19R for electrically detecting the operation amount of the grip 25 and electrically operating the control valve of the hydraulic actuator on the basis of the detection result, the hydraulic actuator being configured to drive the operation target; however, the operation devices 19L and 19R are not limited to that configuration. That is, similar to the conventional operation device, the operation devices 19L and 19R may be configured to transmit the operation amount of the grip 25 to the pilot operation switching valve with use of the pressure of the operation fluid (the pilot pressure) and to control the hydraulic actuator that is configured to drive the operation target with use of the pilot operation switching valve.

In the present embodiment, each of the operation devices 19L and 19R includes the base 21, the first yoke 42 fitted to the base 21, the second yoke 44 coupled to the first yoke 42 rotatably about the first axis Y1 and coupled to the first yoke 42 rotatably about the second axis Y2 different from the first axis Y1, the swing body 24 attached to the second yoke 44, the grip 26 attached to the swing body 24, and the fixing members 51A and 51B which are configured to be inserted through the base 21 and the first yoke 42 fitted to the base 21 and to fix the first yoke 42 to the base 21.

In this manner, the first yoke 42 is fixed to the base 21 by inserting the fixing members 51A and 51B into the base 21 and the first yoke 42 fitted to the base 21, and thus the first yoke 42 can be constantly fixed with respect to the base 21 (the machine body 2) in a fixed orientation.

Conventionally, since a method for fixing the first yoke with respect to the base employs a screw manner in which the screw shaft provided on the first yoke is screwed into the base, the first yoke is fixed in an arbitrary orientation with respect to the base. That is, the first yoke cannot be constantly fixed in a fixed orientation with respect to the base. Thus, the direction along the first axis and the front-rear direction (the first operation direction) are in an arbitrary positional relationship, and the direction along the second axis and the machine width direction (the second operation direction) are in an arbitrary positional relationship. In a case where the first axis is not parallel to the first operation direction and the second axis is not parallel to the second operation direction, a feeling of strangeness and variation arises due to the difference between the operation direction and the moving manner of the grip when the grip is moved in any oblique direction between the first operation direction and the second operation direction in the full stroke. The feeling of strangeness and variation are more likely to be felt as the distance from the grip to the rotation fulcrum is shorter.

In the present embodiment, the first yoke 42 can be constantly fixed to the base 21 (the machine body 2) in a fixed orientation, and thus the direction along the first axis Y1 and the front-rear direction K1 (the first operation direction) can be parallel to each other and the direction along the second axis Y2 and the machine width direction K2 (the second operation direction) can be parallel to each other. In this manner, the operation angles of the grip 25 can be equal in the front-rear direction K1 and in the machine width direction K2 in the combined operation, and thus the operation in the combined operation can be performed smoothly. In addition, even in the case where the distance from the grip 25 to the rotational fulcrum Y3 is shortened, it is possible to prevent the operator from being given a strange feeling depending on the operation direction.

Further, the conventional technique is unable to detect the operation angle of the grip 25 in the supporting portion 22 (a universal joint). In the present embodiment, the first axis Y1 and the first operation direction can be reliably made to coincide with each other, and the second axis Y2 and the second operation direction can be reliably made to coincide with each other; thus, the operation angle of the grip 25 can be detected on the basis of the rotation about the first axis Y1 and the rotation about the second axis Y2. In this manner, it is possible to provide the operation devices 19L and 19R having a compact and simple structure.

In addition, when the grip 25 is attached to the swing body 24 that is attached to the second yoke 44, the distance from the grip 25 to the rotation fulcrum Y3 of the grip 25 can be shortened. In this manner, it is possible to reduce the amount of hand-operated operation of the grip 25 in operation, and thereby it is possible to reduce the space for the operation of the grip 25. In addition, since the distance from the grip 25 to the rotation fulcrum Y3 is long in the conventional technique, there is a case where the grip 25 relatively swings with respect to the machine body 2 when the machine body 2 is shaken. On the other hand, in the present embodiment, when the machine body 2 is shaken, the hand of the operator holding the grip 25 sways together with the machine body 2, and thus the operation can be stably performed. Meanwhile, the present embodiment describes the configuration in which the rotation fulcrum Y3 is arranged in the grip 25; however, the present invention is not limited to that configuration, and the rotation fulcrum Y3 may be arranged outside the grip 25 (for example, a position slightly lower than the grip 25).

In addition, the base 21 has the fitting hole 29 formed in the upper surface of the base 21 and has the first pin holes 31A and 31B which penetrate the base 21 across the fitting hole 29, the first yoke 42 has the attachment portion 48 having a rod shape to be fitted to the fitting hole 29, and has the second pin holes 50A and 50B respectively communicated with the first pin holes 31A and 31B when the attachment portion 48 is fitted into the fitting hole 29, and the fixing members 51A and 51B are both pins inserted through the first pin holes 31A and 31B and the second pin holes 50A and 50B.

As described above, the structure for assembling the first yoke 42 to the base 21 can be easily configured, and the first yoke 42 can be easily assembled to the base 21 at an appropriate assembling angle.

In addition, provided are the attachment shaft 54 protruding from the second yoke 44, penetrating the swing body 24 and having a threaded portion 54*a* on the tip end side, the turn-restricting portion 72 configured to restrict the second yoke 44 and the swing body 24 from relatively rotating about the attachment shaft 54, and the fastening tools 68A and 68B screwed into the threaded portion 54*a* to fix the swing body 24 to the second yoke 44.

According to this, it is possible to easily attach the grip 25 to the second yoke 44.

In addition, provided is the shim 69 interposed between the second yoke 44 and the swing body 24 and configured to adjust the position of the swing body 24 along the extending direction of the attachment shaft 54.

In this manner, the position of the swing body 24 in the height direction can be adjusted with respect to the second yoke 44.

In addition, the first axis Y1 is substantially parallel to the front-rear direction K1 of the operator seat 6 on which the operator operating the grip 25 is seated, and the second axis Y2 is substantially parallel to a horizontal direction (the machine width direction K2) orthogonal to the front-rear direction K1.

According to this, the operation feeling of the operator is improved as compared with the cases where the second axis Y2 is defined to be substantially parallel to the front-rear direction K1 and where the first axis Y1 is defined to be substantially parallel to the horizontal direction orthogonal to the front-rear direction K1.

In addition, the rotation fulcrum Y3 of the grip 25, which is the intersection of the first axis Y1 with the second axis Y2, is arranged inside the grip 25.

According to this, the operator can grasp the position close to the rotation fulcrum Y3 of the grip 25. In other words, when the operator grips the grip 25, the rotation fulcrum Y3 of the grip 25 can be located (in an area covered with the hand) at a position to be wrapped with the hand of the operator. In this manner, it is possible to reduce the amount of hand-operated operation in the operation of the grip 25, and it is possible to reduce the space for the operation of the grip 25. In addition, when the machine body 2 is shaken, the hand sways together with the machine body 2, so that the operation can be performed stably.

Further provided are the plurality of push rods 23A arranged such that one ends thereof are in contact with the swing body 24 around the rotation fulcrum Y3 of the grip 25 which is an intersection point of the first axis Y1 with the second axis Y2, the detection devices 58A and 58B configured to detect the movement amounts of the push rods 23A to 23D, and the pushing members 63A to 63D configured to push the push rods 23A to 23D toward the side of the one ends along the extending directions of the push rods 23A to 23D, when the grip 25 is not rotated, the position of the grip 25 is regulated to the neutral position by the push rods 23A to 23D, and when the grip 25 is rotated, at least one of the push rods 23A to 23D is pushed by the grip 25 via the swing body 24 so that the push rods 23A to 23D overcome the pushing force of the pushing members 63A to 63D and move in the extending directions of the push rods 23A to 23D.

According to this, since the operation amount of the grip 25 can be detected by the detection device, the operation target can be operated in the electronic control, and thereby the structure around the push rod can be reduced. That is, it is possible to simplify the structure, and thus an operation device with a small and simple structure can be provided. In addition, the freedom of design around the push rods is enhanced.

In addition, provided are the sleeves 36A to 36D respectively through which the push rods 23A to 23D are slidably inserted, the base 21 has the attachment portions 30A to 30D respectively formed with the supporting holes 34A to 34D respectively through which the sleeves 36A to 36D are inserted, and the sleeves 36A to 36D have the retaining portions 37A to 37D configured to come into contact with the attachment portions 30A to 30D so as to regulate the sleeves 36A to 36D from slipping off from the supporting holes 34A to 34D to one ends of the push rods 23A to 23D, and the retaining ring attachment portions 39A to 39D to which the retaining rings 38A to 38D are attached so as to regulate the sleeves 36A to 36D from slipping off from the supporting holes 34A to 34D to the other ends of the push rods 23A to 23D, and further the contacting portions 62A to 62D are provided on the other end sides of the push rods 23A to 23D, the contacting portions 62A to 62D being configured to restrict the push rods 23A to 23D from slipping off from the sleeves 36A to 36D to one ends of the push rods 23A to 23D by coming into contact with the retaining portions 37A to 37D.

In the conventional technique, a plate for preventing the four sleeves from slipping off is arranged on the upper surface of the base, and then the plate is fastened and fixed to the base together with the first yoke by a screwing structure. In the present embodiment, the sleeves 36A to 36D can be prevented from being slipped off by the retaining portions 37A to 37D to be contacted to the attachment portions 30A to 30D and the retaining rings 38A to 38D attached to the retaining ring attachment portions 39A to 39D, and in this manner, the conventional plate can be omitted. By omitting the conventional plate, the screwing structure of the first yoke 42 provided to the base 21 can also be omitted.

In addition, the plurality of push rods 23A to 23D includes the first push rod 23A arranged on one side of the first axis Y1 in the extending direction with respect to the rotation fulcrum Y3, the second push rod 23B arranged on the other side of the first axis Y1 in the extending direction with respect to the rotation fulcrum Y3, the third push rod 23C arranged on one side of the second axis Y2 in the extending direction with respect to the rotation fulcrum Y3, and the fourth push rod 23D arranged on the other side of the second axis Y2 in the extending direction with respect to the rotation fulcrum Y3, the swing body 24 has a first contacting surface 73A that is contacted to one end side of the first push rod 23A, a second contacting surface 73B that is contacted to one end side of the second push rod 23B, a third contacting surface 73C that is contacted to one end side of the third push rod 23C, and a fourth contacting surface 73D that is contacted to one end side of the fourth push rod 23D, one end sides of the first to fourth push rods 23D each have curved surface shapes convex toward the swing body 24, the first and second contacting surfaces 73A and 73B each have curved surface shapes that are curved around a line parallel to the second axis Y2 under the state where the grip 25 is arranged at the neutral position, and the third and the fourth contacting surfaces 73C and 73D each have planar shapes parallel to the first axis Y1 and the second axis Y2 under the state where the grip 25 is arranged at the neutral position.

According to this, in the case where the operation amount of the grip 25 is detected by the detection device configured to detect the rotation of the grip 25 around the first axis Y1 and the rotation of the grip 25 around the second axis Y2, the operation amount can be accurately detected.

In addition, further provided are the coupling body 43 coupled to the first yoke 42 so as to be rotatable about the first axis Y1 and coupled to the second yoke 44 so as to be rotatable about the second axis Y2, the first shaft member 53A and the second shaft member 53B arranged on the first axis Y1, and the third shaft member 53C and the fourth shaft member 53D arranged on the second axis Y2, the first yoke 42 includes a first coupling portion 46A rotatably coupled to the coupling body 43 by the first shaft member 53A and a second coupling portion 46B rotatably coupled to the coupling body 43 by the second shaft member 53B, the second yoke 44 has the third coupling portion 46C rotatably coupled to the coupling body 43 by the third shaft member 53C and the fourth coupling portion 46D rotatably coupled to the coupling body 43 by the fourth shaft member 53D, and the first shaft member 53A, the second shaft member 53B, the third shaft member 53C, and the fourth shaft member 53D are fixed to the coupling body 43 by the pins.

According to this, the first yoke 42, the coupling body 43, and the second yoke 44 can be easily disassembled, and the supporting portion 22 (the universal joint) can be disassembled and repaired.

In addition, the present embodiment has been described the configuration in which the position of the swing body 24 is adjusted along the extending direction of the attachment shaft 54 by inserting the shim 69 between the second yoke 44 and the swing body 24; however, the present invention is not limited to that configuration. For example, the first yoke 42 and the base 21 are not fixed by the fixing members 51A and 51B, but the first yoke 42 may be configured to adjust the position thereof in the extending direction of the attachment shaft 54 in the connecting portion of the first yoke 42 with the base 21. In that case, not only the configuration in which the swing body 24 is attached between the second yoke 44 and the grip 25 but also a configuration in which the grip 25 is directly attached to the second yoke 44 may be employed.

In addition, the operation devices 19L and 19R according to the present embodiment each may be configured to include the first yoke 42, the second yoke 44 coupled rotatably about the first axis and about the second axis different from the first axis with respect to the first yoke 42, the swing body 24 attached to the second yoke 44, and the grip 25 attached to the swing body 24. According to the configuration mentioned above, it is possible to reduce the amount of hand operation in the operation of the grip 25, and thus the space for the operation of the grip 25 can be reduced.

In addition, the operation devices 19L and 19R according to the present embodiment may be configured to include the first yoke 42, the second yoke 44 coupled rotatably about the first axis and about the second axis different from the first axis with respect to the first yoke 42, and the grip 25 attached to the second yoke 44. Alternatively, the swing body 24 may be integrally formed with the second yoke 44. Even in these cases, when the rotation fulcrum of the grip 25 is arranged in the grip 25 or in the vicinity of the grip 25 to shorten the distance from the grip 25 to the rotation fulcrum Y3 of the grip 25, it is possible to reduce the amount of hand operation in the operation of the grip 25, and thus the space for the operation of the grip 25 can be reduced.

In addition, in the present embodiment, the operation devices 19L and 19R include the grip 25 to be gripped by an operator and a supporting portion 22 configured to supporting the grip 25 rotatably in an arbitrary rotational direction, and the rotation fulcrum Y3 of the grip 25 is positioned inside the grip 25. That is, the operator can grasp a position close to the rotation fulcrum Y3 of the grip 25. In this manner, it is possible to reduce the amount of hand operation in the operation of the grip 25, and thus the space for the operation of the grip 25 can be reduced. In addition, in the conventional technique, since the distance from the grip 25 to the rotation fulcrum Y3 is long, the grip 25 may largely swing relatively with respect to the machine body 2 when the machine body 2 is shaken. On the other hand, in the present embodiment, when the machine body 2 is shaken, the hand of the operator holding the grip 25 is swung together with the machine body 2, so that the operation can be stably performed.

In addition, the rotation fulcrum Y3 is located in a region surrounded by the first grip portion 74 that is a portion of the grip 25 gripped by the operator with the palm of the hand contacted to the portion.

According to this, the rotation fulcrum Y3 of the grip 25 is located at a position (in a region covered with the hand) to be wrapped by the operator's hand. In this manner, it is possible to reliably reduce the amount of hand operation of the grip 25 and to ensure the stable operation.

In addition, the supporting portion 22 is housed inside the grip 25.

In this manner, the operation devices 19L and 19R can be downsized.

In addition, the supporting portion 22 includes the base 21, and the supporting portion 22 and the fixing portion 21A that is a portion of the base 21 to which the supporting portion 22 is attached are inserted to the inside of the grip 25.

In this manner, it is possible to further reduce the size of the operation devices 19L and 19R.

In addition, the grip 25 has a hollow shape with the bottom surface 25A opened, and the inner surface of the lower portion of the grip 25 has an opening area that gradually increases toward the bottom surface 25A side.

In the case where the grip 25 internally has the rotation fulcrum Y3, the grip 25 is swung in a direction in which a part of the lower portion approaches a portion close to the rotation fulcrum Y3 side when the grip 25 is rotated. Since the inner surface of the lower portion of the grip 25 is formed such that the opening area gradually increases toward the bottom surface 25A side, it is possible to prevent the lower portion of the grip 25 from coming into contact with the portion on the side of the rotation fulcrum Y3, and thus the rotation amount (the operation amount) of the grip 25 can be ensured.

In addition, the supporting portion 22 includes the first yoke 42 fixed to the base 21, the second yoke 44 attached to the grip 25 directly or via another member, and the coupling body 43 coupling the first yoke 42 and the second yoke 44 to each other, and the coupling body 43 is connected to the first yoke 42 so as to be rotatable about the first axis Y1, and the second yoke 44 is connected to the coupling body 43 so as to be rotatable about the second axis Y2 different from the first axis Y1.

By coupling the first yoke 42 and the second yoke 44 via the coupling body 43, the first yoke 42 and the second yoke 44 can be assembled easily.

In addition, further provided are the plurality of push rods 23A to 23D which are arranged symmetrically with respect to the imaginary straight line Y4 passing through the rotation fulcrum Y3 and arranged at a position where one end is contacted to the grip 25 directly or via another member, the detection devices 58A and 58B configured to detect the movement amounts of the push rods 23A to 23D, and the pushing members 63A to 63D configured to push the push rods 23A to 23D to one end sides of the pushing members 63A to 63D along the extending directions of the push rods 23A to 23D, the position of the grip 25 is regulated to the neutral position by the push rods 23A to 23D when the grip 25 is not rotated, and when the grip 25 is rotated, at least one of the push rods 23A to 23D is pushed by the grip 25 directly or via another member in accordance with the rotational direction so that the push rods 23A to 23D overcome the pushing force of the pushing members 63A to 63D and move in the extending directions of the push rods 23A to 23D.

According to this, it is possible to operate the operation target under the electronic control, and thus the structure can be simplified.

In addition, the grip 25 has a hollow shape with the bottom surface 25A opened, and the inner surface of the grip 25 has a distance from the imaginary straight line Y4, the distance gradually increasing toward the bottom surface 25A side from the positions corresponding to one end sides of the push rods 23A to 23D, each of the push rods 23A to 23D is inserted into the grip 25 from the bottom surface 25A of the grip 25 such that the one end sides thereof are arranged on the deep inner side 25B of the grip 25 and arranged such that the distance from the imaginary straight line Y4 gradually decreasing from the one end side toward the other end side.

In the case where the grip 25 internally has the rotation fulcrum Y3, the grip 25 is swung in a direction in which a part of the bottom surface 25A approaches a portion close to the rotation fulcrum Y3 side when the grip 25 is rotated. The more the inner surface of the grip 25 is close to the bottom surface 25A from the positions corresponding the one end sides of the push rods 23A to 23D, the more the distance from the imaginary straight line Y4 is long, thus the bottom surface 25A side of the grip 25 can be prevented from coming into contact with the portion on the rotation fulcrum Y3 side, and it is possible to ensure the rotation amount (the operation amount) of the grip 25. In addition, each of the push rods 23A to 23D is inserted into the grip 25 from the bottom surface 25A of the grip 25 such that one end sides thereof are arranged on the deep inner side 25B of the grip 25 and such that the distance from the imaginary straight line Y4 gradually decreases toward the one end sides from the other end sides, and each of the push rods 23A to 23D is inclined so as to gradually shift toward the imaginary straight line Y4 as going from the deep inner side 25B of the grip 25 toward the bottom surface 25A side that is opened. In this manner, it is possible to secure a space between the bottom surface 25A side of the grip 25 and the push rods 23A to 23D, the space allowing to enter the bottom surface 25A side of the grip 25 therein. In other words, the distance between the bottom surface 25A side of the grip 25 and the push rods 23A to 23D can be sufficiently ensured. In this manner, that configuration makes it possible to achieve the compactness.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. An operation device comprising:

a grip to be grasped by an operator, the grip having a hollow shape with an open bottom surface;

a supporting portion housed inside the grip to support the grip and allowing the grip to be turned in an arbitrary turning direction;

a base to which the supporting portion is attached; and a plurality of pushrods at least partially disposed within the base and configured to be pressed by the grip during operation of the grip, each of the plurality of pushrods includes a respective axial center axis disposed obliquely relative to an upper surface of the base;

a boot including an upper portion attached around the open bottom surface of the grip, and a lower portion attached to the base, wherein a rotation fulcrum of the grip is positioned inside the grip and above the boot.

2. The operation device according to claim 1, wherein the supporting portion is housed in an inner space of a region in the grip surrounded by a portion to be gripped by an operator bringing a palm and fingers into contact with the portion.

3. The operation device according to claim 1, wherein the grip houses inside the supporting portion and a fixing portion of the base to which the supporting portion is attached.

4. The operation device according to claim 1, wherein an inner surface of a lower portion of the grip has an opening area gradually enlarged toward the open bottom surface.

5. The operation device according to claim 1, wherein the supporting portion includes:

a first yoke fixed to the base;

a second yoke directly attached to the grip or attached to the grip via another member; and a coupling body coupling the first yoke to the second yoke, wherein the coupling body is coupled to the first yoke and configured to be turned about a first axis, and wherein the second yoke is coupled to the coupling body and configured to be turned about a second axis other than the first axis.

6. The operation device according to claim 1, comprising:

the plurality of pushrods are arranged symmetrically with respect to an imaginary straight line passing through the rotation fulcrum and arranged on a position where ends of the pushrods directly contact to the grip or contact to the grip via another member;

a detection device to detect a movement amount of each of the pushrods; and a respective pushing member pushing each of the pushrods towards the respective end along the respective axial center axis of each of the pushrods, wherein a position of the grip is limited to a neutral position by each of the pushrods when the grip is not turned, and wherein when the grip is turned, at least one of the plurality of pushrods is pushed by the grip or pushed by the grip via another member in accordance with a direction of the turning, and the grip moves along the respective axial center axis of the at least one of the plurality of pushrods against a respective pushing force of the respective pushing member of the at least one of the plurality of pushrods.

7. The operation device according to claim 6, wherein an inner surface of the grip takes a distance from the imaginary straight line, the distance being gradually increased toward the open bottom surface from the respective positions corresponding to the respective ends of the pushrods, and wherein each of the pushrods is inserted into the grip from the bottom surface of the grip such that the respective end of the pushrod is arranged in the grip and such that the distance from the imaginary straight line is gradually decreased from the respective end toward a respective opposed end.

8. The operation device according to claim 1, wherein the supporting portion includes:

a first yoke fitted to the base;

a second yoke coupled to the first yoke and configured to be turned about a first axis, and coupled to the first yoke and configured to be turned about a second axis other than the first axis; and a swing body attached to the second yoke, wherein the grip is attached to the swing body, and wherein the operation device includes a fixing member inserted to the base and to the first yoke fitted to the base and configured to fix the first yoke to the base.

9. The operation device according to claim 8, further comprising:

an attachment shaft protruding from the second yoke, penetrating the swing body, and having a threaded portion at a tip end portion;

a turn-restricting portion to regulate the second yoke and the swing body to relatively turn about the attachment shaft; and a fastening tool screwed to the threaded portion and configured to fix the swing body to the second yoke.

10. The operation device according to claim 8, further comprising:

a shim arranged between the second yoke and the swing body and configured to adjust a position of the swing body in a longitudinal direction of the attachment shaft.

11. The operation device according to claim 8, wherein the first axis is substantially parallel to an anteroposterior direction of a seat on which an operator operating the grip sits, and wherein the second axis is substantially parallel to a horizontal direction perpendicular to the anteroposterior direction.

12. The operation device according to claim 8, the rotation fulcrum being an intersection point of the first axis with the second axis.

13. The operation device according to claim 8, comprising:

the plurality of pushrods are arranged around the rotation fulcrum of the grip that is the intersection point of the first axis with the second axis such that a respective end of each of the plurality of pushrods contacts the swing body;

a detection device to detect a movement amount of each of the plurality of pushrods; and a respective pushing member pushing each of the plurality of pushrods towards the respective end along the respective axial center axis of each of the plurality of pushrods, wherein a position of the grip is limited to a neutral position by each of the plurality of pushrods when the grip is not turned, and wherein when the grip is turned, at least one of the plurality of pushrods is pushed by the grip via the swing body in accordance with a direction of the turning, and the grip moves along the respective axial center axis of the at least one of the plurality of pushrods against a respective pushing force of the respective pushing member of the the at least one of the plurality of pushrods.

14. The operation device according to claim 13, further comprising a respective sleeve to which each of the plurality of pushrods is slidably inserted, wherein the base includes a respective attachment portion having a respective supporting hole to which the respective sleeve of each of the plurality of pushrods is inserted, wherein each respective sleeve includes:

a respective retaining portion to be contacted to the respective attachment portion such that the respective sleeve is prevented from slipping off from the respective supporting hole to the respective end of one of the plurality of pushrods; and a respective retainer ring attachment portion to which a respective retainer ring is attached such that the respective sleeve is prevented from slipping off from the respective supporting hole to a respective opposed end to the respective end of the one of the plurality of pushrods, and wherein each of the respective opposed ends is provided with a respective contacting portion to be contacted to the respective retaining portion such that the respective sleeve is prevented from slipping off from the respective sleeve to the respective end of the one of the plurality of pushrod.

15. The operation device according to claim 1, wherein the supporting portion includes:

a first yoke fitted to the base;

a second yoke coupled to the first yoke rotatably about a first axis and rotatably about a second axis other than the first axis; and a swing body attached to the second yoke, and wherein the grip is attached to the swing body.

16. The operation device according to claim 1 wherein the supporting portion includes:

a first yoke fitted to the base;

a second yoke coupled to the first yoke rotatably about a first axis and rotatably about a second axis other than the first axis; and wherein the grip is attached to the second yoke.

17. A working machine comprising the operation device according to claim 1.

18. An operation device comprising:

a base;

a first yoke fitted to the base;

a second yoke coupled to the first yoke and configured to be turned about a first axis, and coupled to the first yoke and configured to be turned about a second axis other than the first axis;

a swing body attached to the second yoke;

a grip attached to the swing body; and a fixing member inserted to the base and to the first yoke fitted to the base and configured to fix the first yoke to the base, wherein the base has:

a fitting hole formed on an upper surface of the base; and a first pin hole penetrating the base across the fitting hole, wherein the first yoke has:

an attachment portion fitted into the fitting hole, the attachment portion having a bar shape; and a second pin hole communicated with the first pin hole when the attachment portion is fitted into the fitting hole, and wherein the fixing member is constituted of a pin to be inserted into both of the first pin hole and the second pin hole.

19. An operation device comprising:

a base;

a first yoke fitted to the base;

a second yoke coupled to the first yoke and configured to be turned about a first axis, and coupled to the first yoke and configured to be turned about a second axis other than the first axis;

a swing body attached to the second yoke;

a grip attached to the swing body;

a fixing member inserted to the base and to the first yoke fitted to the base and configured to fix the first yoke to the base;

a plurality of pushrods arranged around the rotation fulcrum of the grip that is the intersection point of the first axis with the second axis such that ends of the pushrods contact to the swing body;

a detection device to detect a movement amount of each of the plurality of pushrods; and a respective pushing member pushing each of the plurality of pushrods towards the respective end along a respective longitudinal direction of each of the plurality of pushrods, wherein a position of the grip is limited to a neutral position by each of the plurality of pushrods when the grip is not turned, wherein when the grip is turned, at least one of the plurality of pushrods is pushed by the grip via the swing body in accordance with a direction of the turning, and the grip moves toward the longitudinal directions of the plurality of pushrods against a pushing force of the pushing member, wherein the plurality of pushrods include:

a first pushrod arranged at one side in a longitudinal direction of the first axis with respect to the rotation fulcrum;

a second pushrod arranged at an opposed side in the longitudinal direction of the first axis with respect to the rotation fulcrum;

a third pushrod arranged at one side in a longitudinal direction of the second axis with respect to the rotation fulcrum; and a fourth pushrod arranged at the opposed side in the longitudinal direction of the second axis with respect to the rotation fulcrum, wherein the swing body includes:

a first contacting surface to be contacted to the respective end of the first pushrod;

a second contacting surface to be contacted to the respective end of the second pushrod;

a third contacting surface to be contacted to the respective end of the third pushrod; and a fourth contacting surface to be contacted to the respective end of the fourth pushrod, wherein each of the first contacting surface and the second contacting surface has a curved surface shape curved around a line parallel to the second axis under a state where the grip is positioned at the neutral position, and wherein each of the third contacting surface and the fourth contacting surface has a flat surface shape parallel to the first axis and the second axis under the state where the grip is positioned at the neutral position.

20. An operation device comprising:

a base;

a first yoke fitted to the base;

a second yoke coupled to the first yoke and configured to be turned about a first axis, and coupled to the first yoke and configured to be turned about a second axis other than the first axis;

a swing body attached to the second yoke;

a grip attached to the swing body;

a fixing member inserted to the base and to the first yoke fitted to the base and configured to fix the first yoke to the base;

a coupling body coupled to the first yoke rotatably about the first axis and coupled to the second yoke rotatably about the second axis;

a first shaft member and a second shaft member each arranged on the first axis; and a third shaft member and a fourth shaft member each arranged on the second axis, wherein the first yoke includes:

a first coupling portion rotatably coupled to the coupling body by the first shaft member; and a second coupling portion rotatably coupled to the coupling body by the second shaft member, wherein the second yoke includes:

a third coupling portion rotatably coupled to the coupling body by the third shaft member; and a fourth coupling portion rotatably coupled to the coupling body by the fourth shaft member, and wherein the first shaft member, the second shaft member, the third shaft member, and the fourth shaft member are fixed to the coupling body by a pin.

* * * * *